US010687160B2

(12) United States Patent
Ostrin et al.

(10) Patent No.: US 10,687,160 B2
(45) Date of Patent: Jun. 16, 2020

(54) WIRELESS AUDIO ANALYSIS, TEST, AND MEASUREMENT

(71) Applicant: Audio Precision, Inc, Beaverton, OR (US)

(72) Inventors: Kenneth Ostrin, Beaverton, OR (US); Fredrick Capell, Jr., Beaverton, OR (US); Joseph Begin, Beaverton, OR (US)

(73) Assignee: AUDIO PRECISION, INC., Beaverton, OR (US)

( * ) Notice: Subject to any disclaimer, the term of this patent is extended or adjusted under 35 U.S.C. 154(b) by 145 days.

(21) Appl. No.: 15/715,000

(22) Filed: Sep. 25, 2017

(65) Prior Publication Data

US 2018/0103331 A1 Apr. 12, 2018

Related U.S. Application Data

(60) Provisional application No. 62/405,767, filed on Oct. 7, 2016.

(51) Int. Cl.
*H04R 29/00* (2006.01)

(52) U.S. Cl.
CPC ..... *H04R 29/001* (2013.01); *H04R 2420/07* (2013.01)

(58) Field of Classification Search
CPC ..... H04R 29/00–008; H04R 2420/07
USPC ..... 381/58, 59, 96; 714/46; 715/716; 702/108, 122
See application file for complete search history.

(56) References Cited

U.S. PATENT DOCUMENTS

| | | | | |
|---|---|---|---|---|
| 5,475,315 | A * | 12/1995 | Cabot | G01R 23/20 324/613 |
| 6,137,992 | A * | 10/2000 | Mohan | H04B 17/20 455/226.1 |
| 6,546,516 | B1 * | 4/2003 | Wright | G10H 1/0066 710/60 |
| 7,155,653 | B2 * | 12/2006 | Monnerat | G01R 31/2825 714/742 |
| 9,955,371 | B1 * | 4/2018 | Koebele | H04W 56/0025 |
| 2011/0237199 | A1 * | 9/2011 | Venkataraman | H04B 17/24 455/67.11 |
| 2012/0042213 | A1 * | 2/2012 | Zimmerman | H04L 43/12 714/46 |
| 2014/0270211 | A1 * | 9/2014 | Solum | H04R 25/554 381/60 |

* cited by examiner

*Primary Examiner* — Xu Mei
(74) *Attorney, Agent, or Firm* — McCoy Russell LLP

(57) ABSTRACT

Apparatuses, systems and methods associated with an instrument for testing of an audio device are described herein. In embodiments, a module to be coupled to an analyzer may be described. The module may include an antenna, communication circuitry coupled to the antenna, and processor circuitry coupled to the communication circuitry. The processor circuitry may be to receive an indication of a configuration for the module, configure the module in accordance with the configuration, cause the communication circuitry to establish a wireless connection between the module and a device under test (DUT), and cause the communication circuitry to perform a test procedure for the DUT via the wireless connection. Other embodiments may be described and/or claimed.

18 Claims, 26 Drawing Sheets

2500

2502

WIRELESS AUDIO ANALYSIS, TEST, AND MEASUREMENT

RELATED APPLICATION

This application claims priority to U.S. Provisional Application No. 62/405,767, filed Oct. 7, 2016, which is hereby incorporated by reference in its entirety.

TECHNICAL FIELD

Various embodiments generally relate to the field of audio test and measurement.

BACKGROUND

The background description provided herein is for the purpose of generally presenting the context of the disclosure. Unless otherwise indicated herein, the materials described in this section are not prior art to the claims in this application and are not admitted to be prior art by inclusion in this section.

The advent of wireless audio systems has led to the development of test equipment directed to the wireless audio systems. However, legacy test equipment directed to the wireless audio systems have limited features and fail to test some of the features presented by wireless audio systems.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Figure 1:
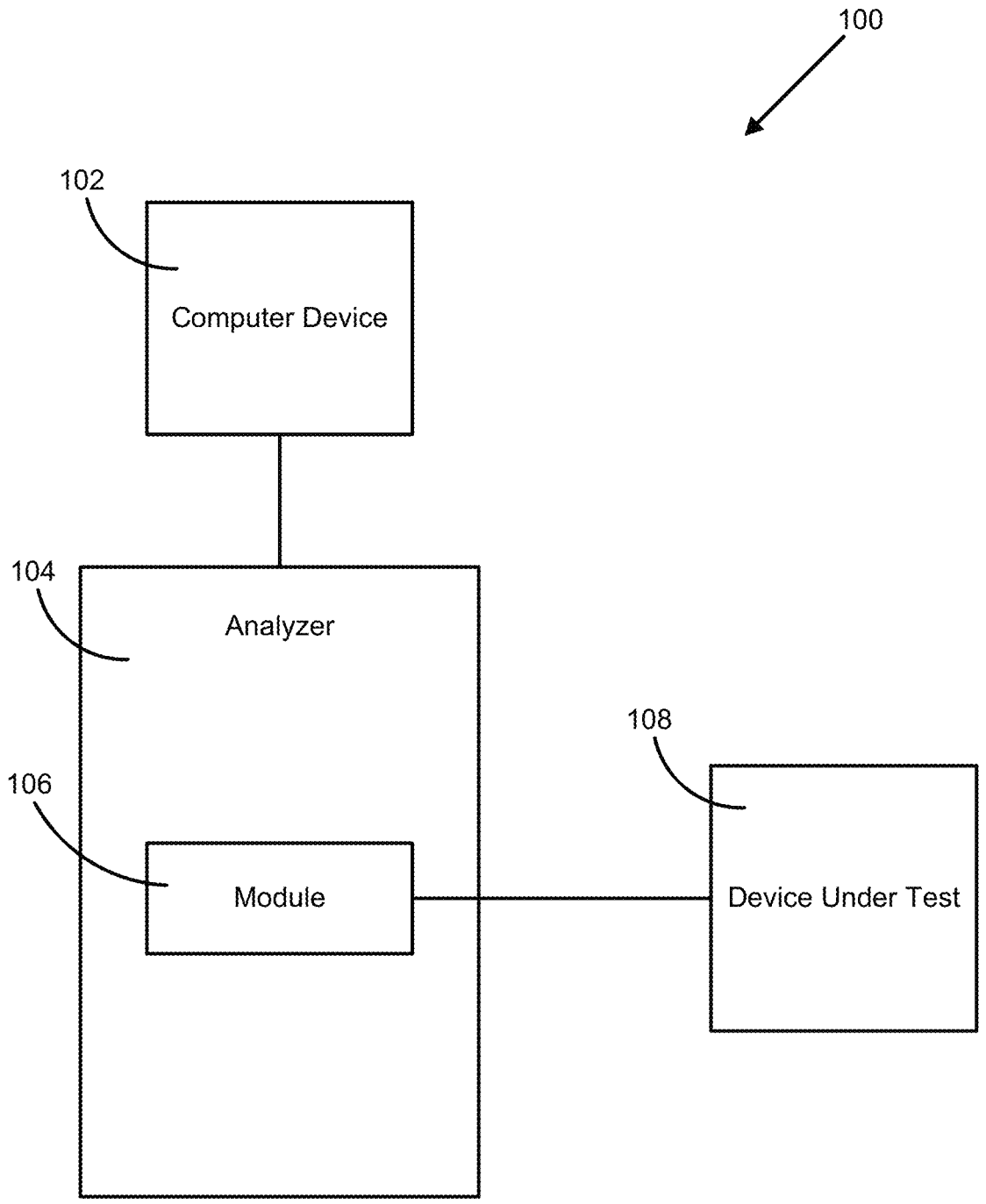
FIG. 1 illustrates an example test arrangement, in accordance with various embodiments.

Apparatuses, methods and storage medium associated with an instrument for testing of an audio device are described herein. In embodiments, a module to be coupled to an analyzer may be described. The module may include an antenna, communication circuitry coupled to the antenna, and processor circuitry coupled to the communication circuitry. The processor circuitry may be to receive an indication of a configuration for the module, configure the module in accordance with the configuration, cause the communication circuitry to establish a wireless connection between the module and a device under test (DUT), and cause the communication circuitry to perform a test procedure for the DUT via the wireless connection. Other embodiments may be described and/or claimed.

In the following detailed description, reference is made to the accompanying drawings which form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that like elements disclosed below are indicated by like reference numbers in the drawings.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

As used herein, the term "circuitry" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

As used herein, the term "signal" may refer to a command, a handshake, a protocol message, a message, a signal, an audio signal, an audio sample, data, information, and/or other similar transmissions.

FIG. 1 illustrates an example test arrangement 100, in accordance with various embodiments. The test arrangement 100 may include a computer device 102. The test arrangement 100 may further include an analyzer 104. The analyzer 104 may be coupled to the computer device 102. The analyzer 104 may include one or more slots for receiving modules, such as module 106. The modules may be coupled to the analyzer 104 when installed within the slots. The modules may be interchangeably installed within the slots of the analyzer 104, such that any type of module may be installed within each the slots. The computer device 102, the analyzer 104, and the module 106 may collectively be referred to as "an instrument" and/or as "an APx instrument." Further, the module 106 may be referred to as "an APx module."

In other embodiments, the modules may be located external to the analyzer 104 and coupled to the analyzer 104. The modules may be wiredly or wirelessly coupled to the analyzer 104 to provide for communication between the modules and the analyzer 104. Further, in some embodiments, a portion of the modules may be coupled to the analyzer 104 via installation within slots of the analyzer 104, while another portion of the modules may be located to external to the analyzer 104 and coupled to the analyzer 104.

In other embodiments, the modules may be coupled directly to the computer device 102. The modules may be wiredly or wirelessly coupled to the computer device 102. In some of these embodiments, the modules may also be coupled to the analyzer 104, while, in other of these embodiments, the modules may be only coupled to the computer device 102. Further, in some embodiments, the modules may be coupled to the analyzer 104 via installation within the slots of the analyzer 104, may be external to the analyzer 104 and coupled to the analyzer 104, may be coupled directly to the computer device 102, or some combination thereof.

Further, in some embodiments, the modules may include circuitry implemented within the analyzer 104 and/or the computer device 102. The circuitry may be a part of the analyzer 104 and/or the computer device 102, such that the module is part of the analyzer 104 and/or the computer device 102 as produced and/or manufactured.

Figure 27:
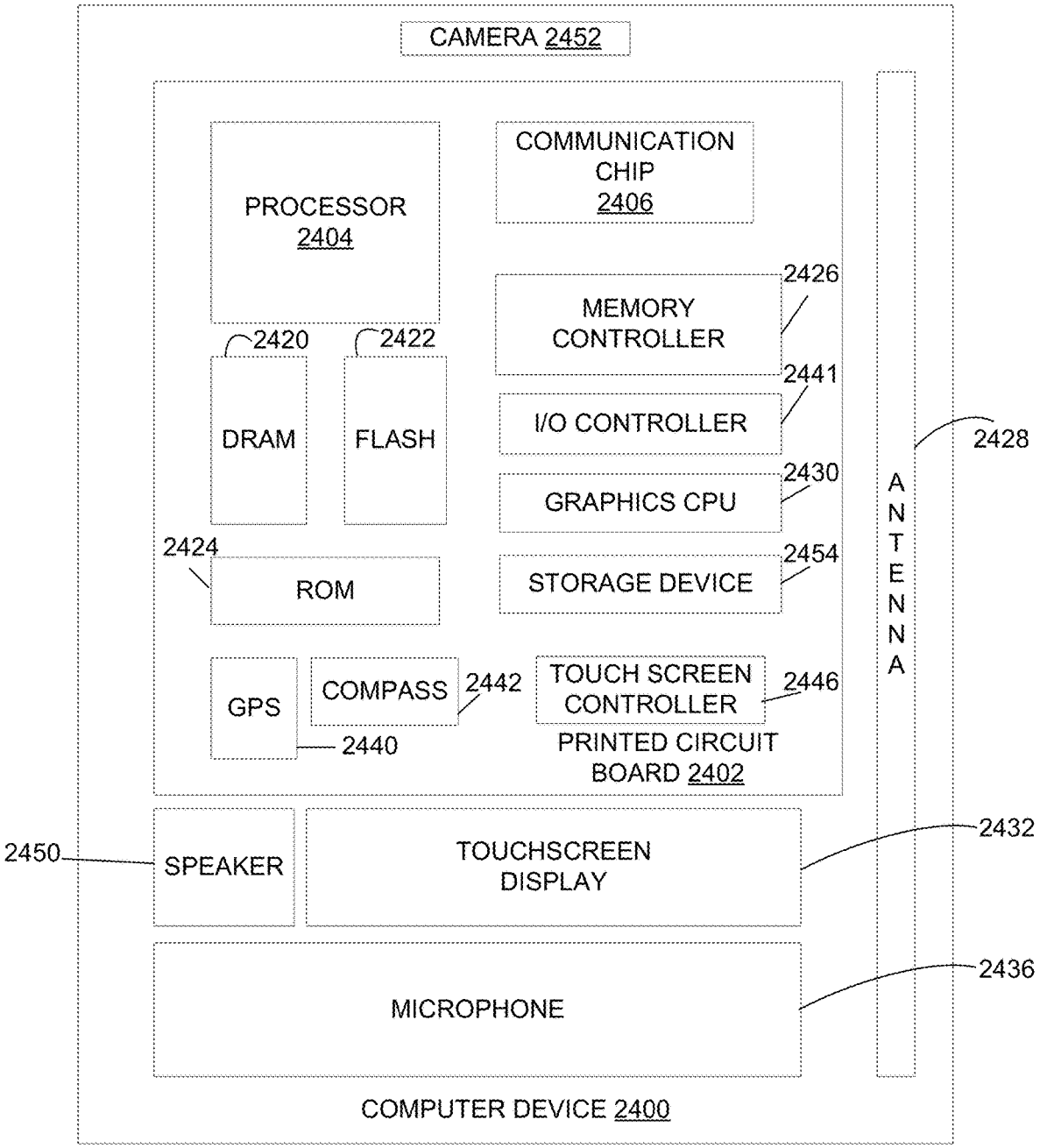
FIG. 27 illustrates an example computer device that may employ the apparatuses and/or methods described herein, in accordance with various embodiments.

The computer device 102 may include one or more of the features of the computer device 2400 (FIG. 27). The computer device 102 may include a computer readable medium having instructions stored thereon, wherein, in response to the computer device 102 executing one or more of the instructions, may cause the computer device 102 to launch a computer application associated with the analyzer 104. The computer application may display a user interface on a display of the computer device 102, wherein a user may interact with the user interface via one or more input devices, such as buttons, a keyboard, a mouse, a touchscreen display, other similar input devices, or some combination thereof. The user interface may allow a user to define configurations, settings, parameters, or some combination thereof, for the analyzer 104 and/or the module 106, and may display results of testing performed by the analyzer 104 and/or the module 106. In some embodiments, the user interface may further allow the user to define configurations, settings, parameters, or some combination thereof, for components of the computer device 102, and may display results of information sensed by the components of the computer device 102.

The analyzer 104 may include one or more processors, memory devices, interfaces, input devices (such as buttons, a keyboard, a mouse, a touchscreen display, and/or other similar input devices), or some combination thereof. Further, the analyzer 104 may include computer readable medium having instructions stored thereon, wherein the instructions, when executed by the analyzer 104, may cause the analyzer 104 to perform one or more operations. The operations may include detecting a type of the module 106, facilitating (such as converting digital signals to analog signals, converting analog signals to digital signals, translating programming languages, or some combination thereof) communication between the computer device 102 and the module 106, encoding and/or decoding signals, or some combination thereof.

In other embodiments, the analyzer 104 may include one or more of the features of the computer device 102 and may perform one or more of the operations described as being performed by the computer device 102. In these embodiments, the computer device 102 may be omitted and the analyzer 104 may provide the user interface with which the user may interact via one or more input devices of the analyzer 104. Further, the analyzer 104 may be a self-contained device that includes one or more of the features of the computer device 102 and/or performs one or more of the operations of the computer device 102 described throughout this disclosure. In some embodiments, the analyzer 104 may include one or more input devices, such as buttons, a keyboard, a mouse, a touchscreen display, other similar input devices, which a user may utilize to define configurations, settings, parameters, or some combination thereof, for the analyzer 104 and/or the module 106. Additionally, in some embodiments, the display of the analyzer 104 may be a visual display, such as light emitting diodes, a liquid crystal display, a cold cathode gas discharge display, a vacuum fluorescent display, an incandescent filament display, a physical vane with electromagnetic activation display, or some combination thereof.

The module 106 may include circuitry and/or hardware to implement wireless communication with devices under test (DUTs). For example, the module 106 may include a chipset and antenna to provide for wireless communication with the DUTs. In some embodiments, the module 106 may include processor circuitry to perform one or more of the operations described throughout this disclosure as being performed by the module 106, wireless communication circuitry (which may include the chipset) to facilitate wireless communication of the module (including formatting, encoding, and/or decoding of signals wirelessly transmitted via the module 108), and one or more antennas to transmit and/or receive wireless communication. The module 106 may implement any wireless communication standard known to one having ordinary skill in the art, including, but not limited to, Bluetooth, infrared, wireless fidelity (Wi-Fi), broadband wireless access, worldwide interoperability for microwave access (WiMAX), high performance radio local access network (HiperLAN), multichannel multipoint distribution service (MMDS), local multipoint distribution service (LMDS), global system for mobile communication (GSM), general packet radio service (GPRS), code division multiple access (CDMA), and/or high-speed downlink packet access (HSPA).

The module 106 may receive information and/or signals from the analyzer 104 and/or from the computer device 102, via the analyzer 104. The information and/or signals received by the module 106 may cause the module 106 to change a configuration of the module 106, communicate with one or more of the DUTs, or some combination thereof. For example, the module 106 may receive settings and/or parameters for the module 106 and may update the configuration of the module 106 based on the setting and/or parameters, as described further throughout this disclosure. Further, for example, the module 106 may receive a signal and/or communication signals and may communicate, via wireless communication, with the device under test (DUT) based on the signal and/or the communication signals.

The module 106 may be upgradeable via upgrades to firmware of the module 106. For example, bug fixes may be implemented and/or new features may be added via upgrading the firmware of the module 106. Upgrading the firmware of the module 106 may include upgrading firmware of the chipset of the module 106. In some embodiments, the firmware of the module 106 may be upgraded by receiving an upgrade for the firmware from the computer device 102 (which may be retrieved by the computer device 102 from a network, such as the internet) and upgrading the firmware with the upgrade received from the computer device 102.

The test arrangement 100 may further include one or more DUTs, such as DUT 108. Although the following description refers to only the DUT 108, it is to be understood that the test arrangement 100 may include one or more DUTs and the DUT 108 may be representative of the DUTs.

The DUT 108 may be a rendering device in some instances or may be a source device in other instances. The rendering device may be a device that is to receive a signal and generate an audio output based on the signal, such as a speaker, a headset, other audio producing devices, or some combination thereof. The source device may be a device that is to generate the signal for the rendering device, such as a phone, a media player, a computer, a personal audio device, other signal producing devices, or some combination thereof.

The module 106 may be configured to communicate with the DUT 108 based on the DUT 108 being the rendering device or the source device. In particular, the module 106 may be configured as a source device (which may be referred to as "advanced audio distribution profile (A2DP) source" or "source" configuration) when the DUT 108 is a rendering device. Further, the module 106 may be configured as a rendering device (which may be referred to as "A2DP sink" or "sink" configuration when the DUT 108 is a source device. The module 106 may be configured as the source device or the rendering device based on a user input to the user interface of the computer device 102. In other embodiments, the module 106 may detect the type of the DUT 108 (i.e. rendering device type or source device type) and may configure itself based on the type of the DUT 108.

Further, the module 106 may adopt a profile consistent with the configuration of the module 106. In particular, if the module 106 is configured as a rendering device, the module 106 may adopt a profile consistent with a rendering device. Further, if the module 106 is configured as a source device, the module 106 may adopt a profile consistent with a source device. For example, if the module 106 is configured as a phone, the module 106 may change its settings to be consistent with settings of a phone and/or may change identifying characteristics within wireless communications of the module 106 to be consistent with identifying characteristics of a phone. In some embodiments, the module 106 may adopt a profile consistent with a certain make and/or model of a device to which the module 106 is to be configured to.

Figure 2:
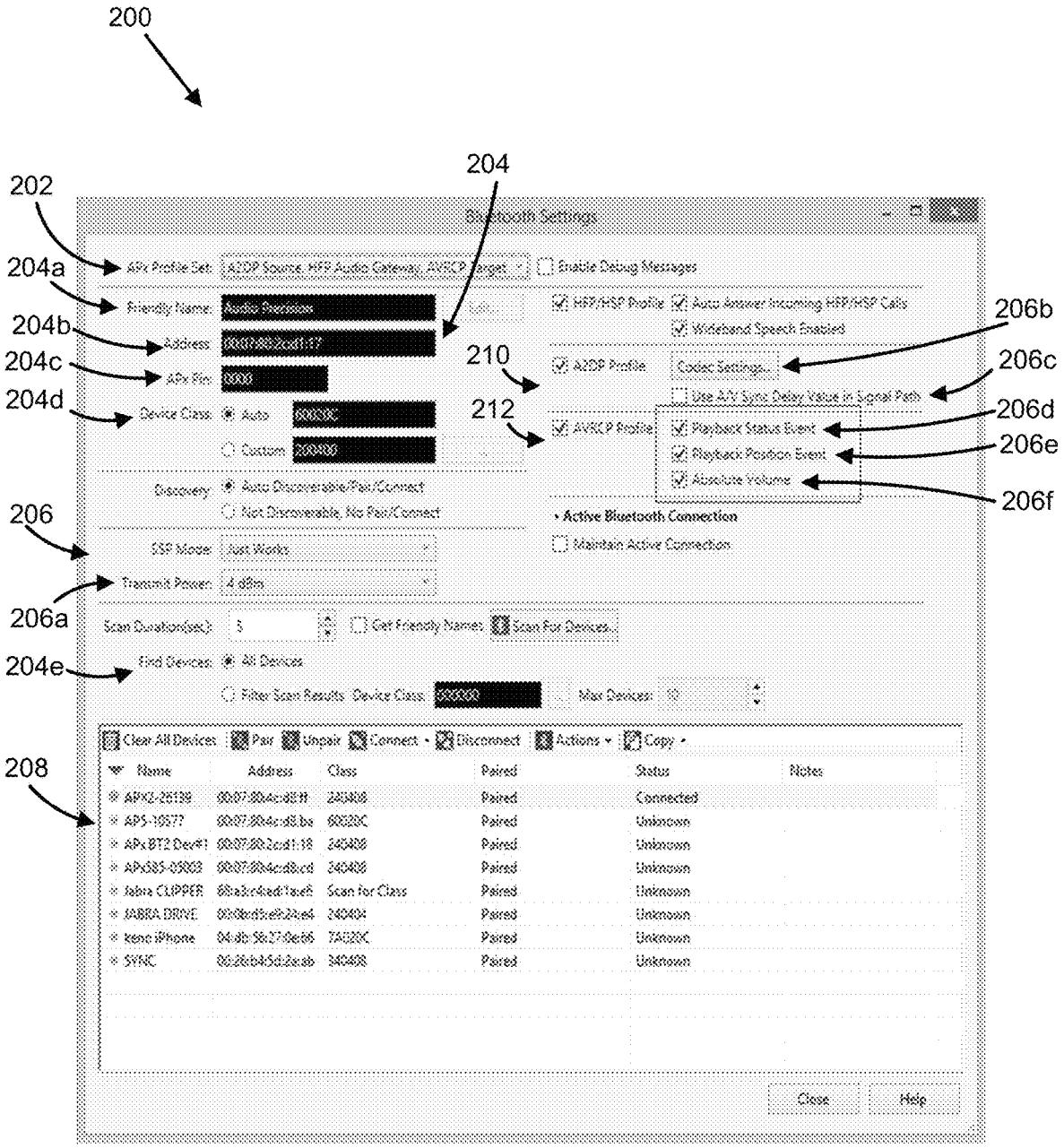
FIG. 2 illustrates an example user interface, in accordance with various embodiments.

FIG. 2 illustrates an example user interface 200, in accordance with various embodiments. The user interface 200 may be displayed on a display of the computer device 102 (FIG. 1) as part of the computer application associated with the analyzer 104 (FIG. 1). The user interface 200 may be displayed prior to performance of a test associated with values with the user interface 200. In other embodiments where the computer device 102 is omitted and the analyzer 104 includes one or more of the features of the computer device 102, the user interface 200 may be displayed on a display of the analyzer 104. A user may interact with the user interface 200, via one or more input devices of the computer device 102 and/or the analyzer 104, to define a configuration and/or parameters for testing of the DUT 108 (FIG. 1) by the instrument.

The user interface 200 may include a profile set input element 202. The profile set input element 202 may provide for input of a configuration of the module 106 for testing of the DUT 108 (FIG. 1). In particular, the profile set input element 202 may allow the user to select that the module 106 is to be configured as a source device, a rendering device, a certain make and/or model of a source device or a rendering device, or some combination thereof.

In response to determining an input to, or a change of value of, the profile set input element 202, the computer application may cause the user interface 200 to be updated based on the configuration input by the user into the profile set input element 202. For example, the user interface 200 may include one or more configuration setting elements 204 that may be updated based on the configuration input by the user. In particular, the configuration setting elements 204 may be updated to default values corresponding to the configuration. The configuration setting elements 204 may include a name value 204*a*, an address value 204*b*, a pin value 204*c*, a device class value 204*d*, a DUT device class filter value 204*e*, or some combination thereof. The computer application may further allow the user to define custom values for one or more of the setting elements 204 via interaction with the computer interface screen 200. The values of the configuration setting elements 204 may include textual values, numerical values, values corresponding to check boxes and/or yes/no selections (which may include true/false values and/or 0/1 values), values corresponding to a list selection, or some combination thereof.

The user interface 200 may further include one or more setting elements 206. The setting elements 206 may include setting values for which there may not be default values based on the configuration input into the profile set input element 202. The setting elements 206 may include a transmit power value 206*a*, codec settings values 206*b*, a sync display value 206*c*, a playback status value 206*d*, a playback position value 206*e*, an absolute volume value 206*f*, or some combination thereof. The values of the setting elements 206 may include textual values, numerical values, values corresponding to check boxes and/or yes/no selections (which may include true/false values and/or 0/1 values), values corresponding to a list selection, or some combination thereof. The codec setting values 206*b* and the sync display value 206*c* may be associated with an A2DP elements subsection 210. The playback status value 206*d*, the playback position value 206*e*, and the absolute volume value 206*f* may be associated with an audio video remote control profile (AVRCP) elements subsection 212.

The user interface 200 may further include a detected device list element 208. The detected device list element 208 may include a list of devices that may have been detected by the module 106 based during a discovery procedure (as is described further throughout this disclosure). The user may select one or more devices from the list of devices in the detected device list element 208 to be DUTs (such as the DUT 108) via interaction with the user interface 200.

In some embodiments, the list of devices in the detected device list element 208 may be a filtered list of devices based on filtering performed by the module 106 and/or the computer application. The list of devices may be filtered based on a type (or class) of the device, a connection strength with the device, a location of the device, or some combination thereof. The filter for filtering of the devices may be defined by a user of the computer application.

Based on the values of the user interface 200, the computer application may initiate one or more operations, as described further throughout this disclosure. The computer application may initiate the operations in response to a trigger, such as a certain interaction with the user interface 200. For example, the user may select an initiate test element in the user interface 200, wherein the selection of the initiate test element may trigger the computer application to initiate the operations based on the values of the user interface 200.

Figure 3:
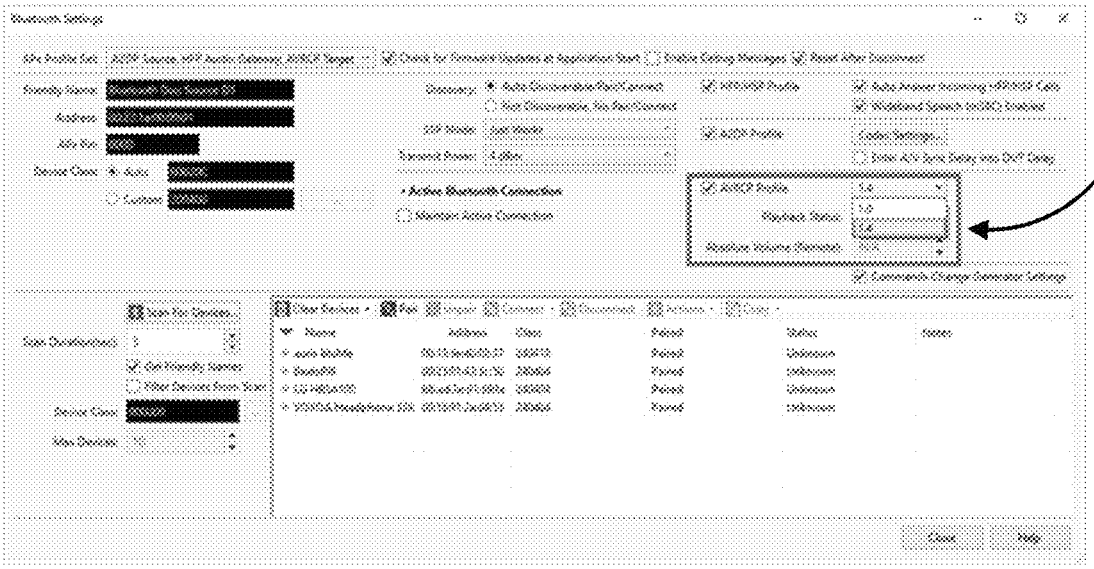
FIG. 3 illustrates another example user interface, in accordance with various embodiments.

FIG. 3 illustrates an example user interface 2500, in accordance with various embodiments. The example user interface 2500 may include one or more of the features of the example user interface 200 (FIG. 2). The user interface 2500 may include an AVRCP elements subsection 2502. The AVRCP elements subsection 2502 may be simplified compared to the AVRCP elements subsection 212 (FIG. 2). In particular, the AVRCP elements subsection 2502 may allow a user to indicate a less capable mode and/or a more capable mode.

In the less capable mode, the module 106 (FIG. 1) and/or the analyzer 104 (FIG. 1) may be configured to pass instructions in a single direction between the DUT 108 (FIG. 1) and the module 106 and/or the analyzer 104. The device receiving the instructions (which may be the DUT 108, the module 106, and/or the analyzer 104) may perform an action and/or provide a response in response to receiving the instructions. Examples of actions that may be performed while in less capable mode may include starting playback of audio and stopping playback of audio.

In the more capable mode, the module 106 may be configured to pass instructions in both directions between the DUT 108 and the module 106 and/or the analyzer 104. The device receiving the instructions (which may be the DUT 108, the module 106, and/or the analyzer 104) may perform an action and/or provide a response in response to receiving the instructions. In addition to the actions that may be performed in the less capable mode, the instructions of the more capable mode may provide for additional actions (such as additional actions related to volume control and audio/visual delay control) and/or may include additional information (such as delay parameters and additional descriptive signals that may describe audio passed between the DUT 108 and the module 106 and/or the analyzer 104.

Figure 4:
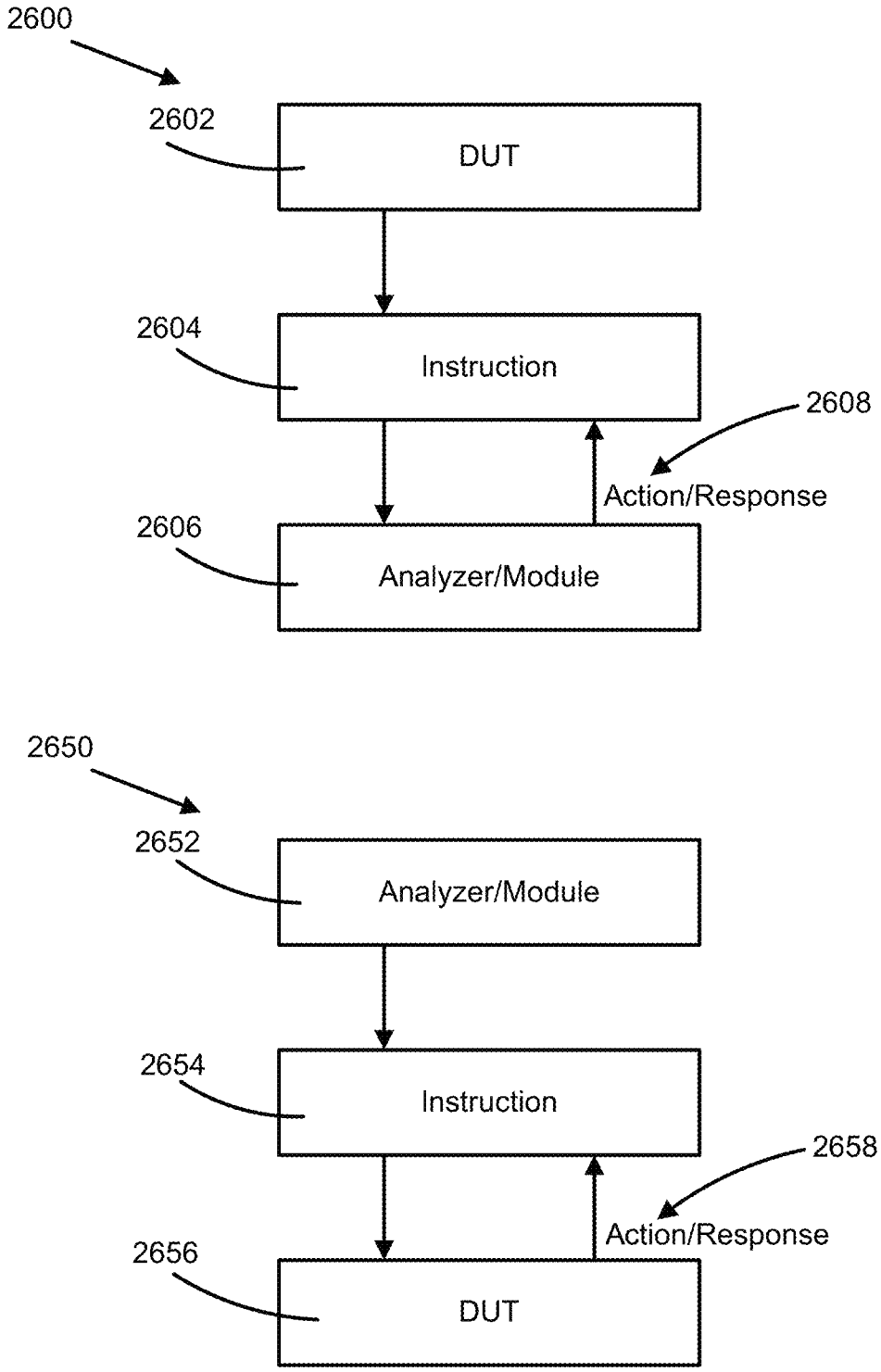
FIG. 4 illustrates example representations associated with a less capable mode, in accordance with various embodiments.

FIG. 4 illustrates example representations associated with a less capable mode, in accordance with various embodiments. Representation 2600 illustrates an example procedure for a DUT 2602, such as the DUT 108 (FIG. 1), to transmit an instruction 2604 to an analyzer and/or module (referred to as the analyzer/module 2606), such as the analyzer 104 (FIG. 1) and/or the module 106 (FIG. 1), while the analyzer/module 2606 is configured in the less capable mode. In particular, the DUT 2602 may transmit the instruction 2604 to the analyzer/module 2606. The instruction 2604 may include a signal for the analyzer/module 2606 to initiate an action, such as starting playback of audio or stopping playback of audio. In response to receiving the instruction 2604, the analyzer/module 2606 may perform an action and/or transmit a response (collectively referred to as action/response 2608) without transmission of additional instructions.

Representation 2650 illustrates an example procedure for an analyzer and/or module (referred to as the analyzer/module 2652), such as the analyzer 104 and/or the module 106, to transmit an instruction 2654 to a DUT 2656, such as the DUT 108, while the analyzer/module 2652 is configured in the less capable mode. In particular, the analyzer/module 2652 may transmit the instruction 2654 to the DUT 2656. The instruction 2654 may include a signal for the DUT 2656 to initiate an action, such as starting playback of audio and stopping playback of audio. In response to receiving the instruction 2654, the DUT 2656 may perform an action and/or transmit a response (collectively referred to as action/response 2658) without transmission of additional instructions.

Figure 5:
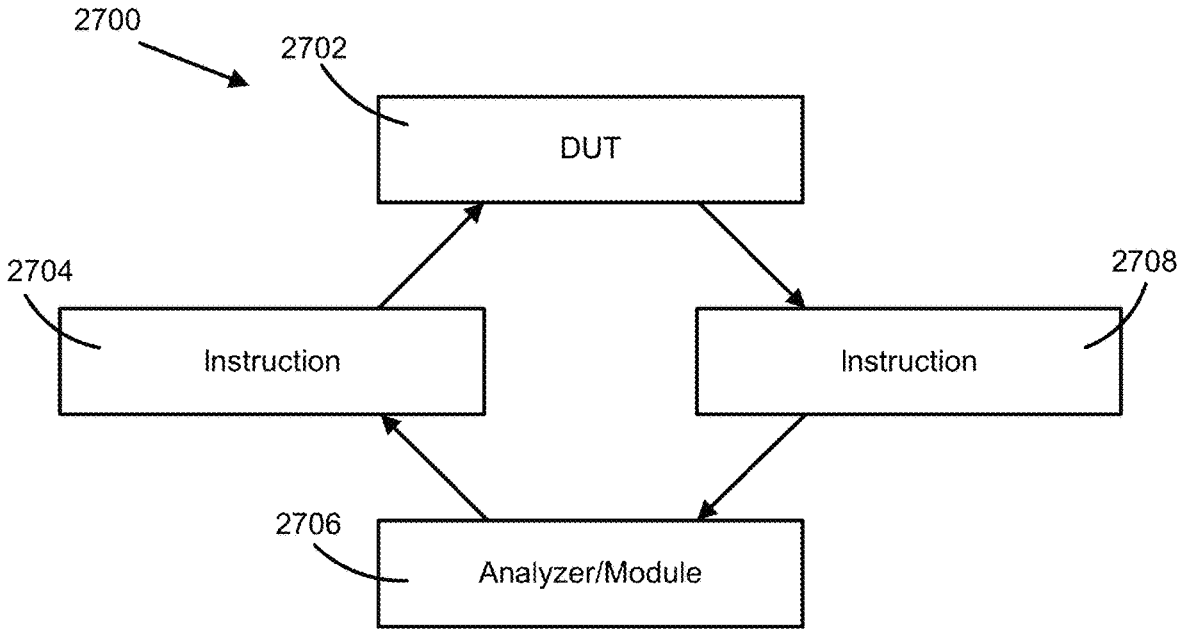
FIG. 5 illustrates example representations associated with a more capable mode, in accordance with various embodiments.
Figure 5:
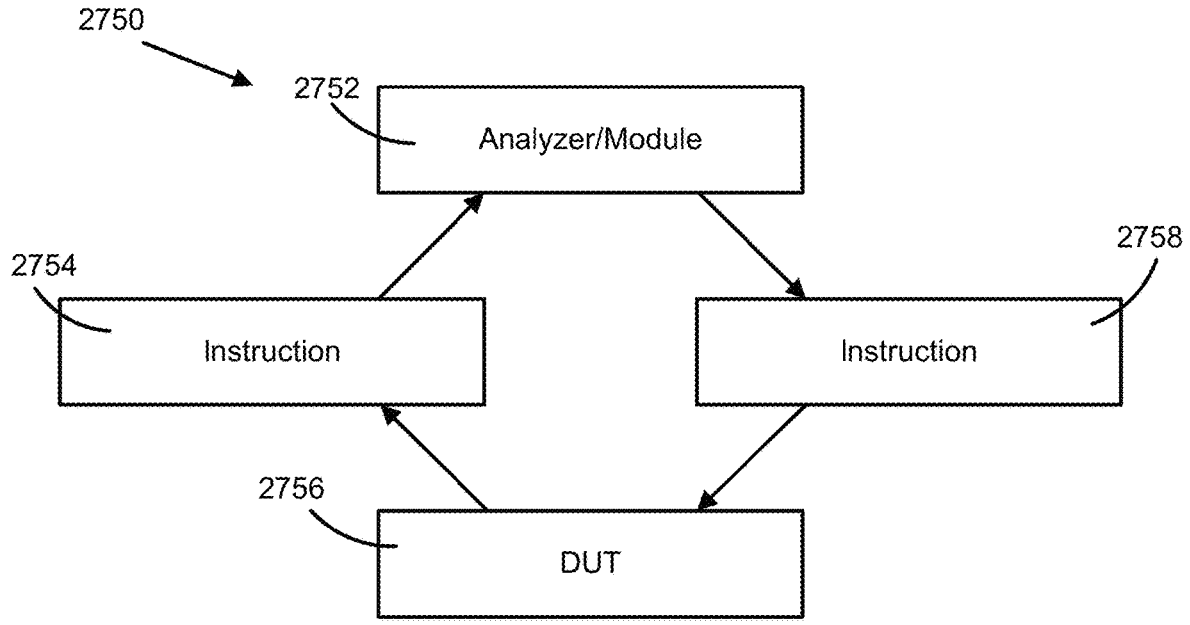

FIG. 5 illustrates example representations associated with a more capable mode, in accordance with various embodiments. Representation 2700 illustrates an example procedure for a DUT 2702, such as the DUT 108 (FIG. 1), to transmit an instruction 2708 to an analyzer and/or module (referred to as the analyzer/module 2706), such as the analyzer 104 (FIG. 1) and/or the module 106 (FIG. 1), while the analyzer/module 2706 is configured in more capable mode. In particular, the DUT 2702 may transmit the instruction 2708 to the analyzer/module 2706. The instruction 2708 may include a signal for the analyzer/module 2706 to initiate an action, such as changing/controlling volume and implementing audio/visual delay, and/or may include additional information, such as delay parameters and additional descriptive signals that may describe audio passed between the DUT 2702 and the analyzer/module 2706.

In response to receiving the instruction 2708, the analyzer/module 2706 may perform an action and/or transmit a response. Additionally, in response to receiving the instruction 2708, the analyzer/module 2706 may transmit an instruction 2704 to the DUT 2702. The instruction 2708 may include a signal for the DUT 2702 to initiate an action, such as changing/controlling volume and implementing audio/visual delay, and/or may include additional information, such as delay parameters and additional descriptive signals that may describe audio passed between the DUT 2702 and the analyzer/module 2706.

Representation 2750 illustrates an example procedure for an analyzer and/or module (referred to as the analyzer/module 2752), such as the analyzer 104 and/or the module 106, to transmit an instruction 2754 to a DUT 2756, such as the DUT 108 (FIG. 1), while the analyzer/module 2752 is configured in more capable mode. In particular, the analyzer/module 2752 may transmit the instruction 2758 to the DUT 2756. The instruction 2758 may include a signal for the DUT 2756 to initiate an action, such as changing/controlling volume and implementing audio/visual delay, and/or may include additional information, such as delay parameters and additional descriptive signals that may describe audio passed between the DUT 2756 and the analyzer/module 2752.

In response to receiving the instruction 2758, the DUT 2756 may perform an action and/or transmit a response. Additionally, in response to receiving the instruction 2758, the DUT 2756 may transmit an instruction 2754 to the analyzer/module 2752. The instruction 2758 may include a signal for the analyzer/module 2752 to initiate an action, such as changing/controlling volume and implementing audio/visual delay, and/or may include additional information, such as delay parameters and additional descriptive signals that may describe audio passed between the DUT 2756 and the analyzer/module 2752.

Figure 6:
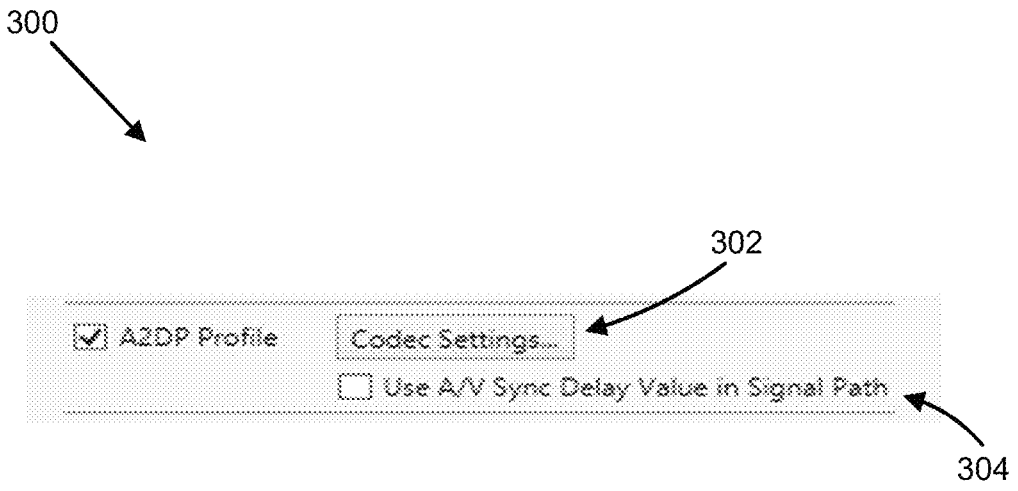
FIG. 6 depicts an example of a subsection element display associated with the advanced audio distribution profile (A2DP) elements subsection of FIG. 2, in accordance with various embodiments.

FIG. 6 depicts an example of a subsection element display 300 associated with the A2DP elements subsection 210 of FIG. 2, in accordance with various embodiments. In particular, the subsection element display 300 may be displayed within the user interface 200 (FIG. 2) in place of the features illustrated in A2DP elements subsection 210 in FIG. 2. The subsection element display 300 may be displayed when the profile set input element 202 (FIG. 2) indicates a configuration associated with a rendering device for the module 106 (FIG. 1).

The subsection element display 300 may include a codec settings element 302. In response to user selection of the codec settings element 302, the computer application may present display 500 (see FIG. 8). The A2DP settings prompt display may allow the user to define encoding and/or decoding settings and/or parameters for configuration of the module 106, as described further in relation to FIG. 8.

The subsection element display 300 may further include an audio/visual synchronization delay element 304. The audio/visual synchronization delay element 304 may allow the user to define whether a synchronization delay value is to be included in certain signals to be transmitted by the module 106. In particular, when the audio/visual synchronization delay element 304 is enabled, the configuration for the module 106 may include having a synchronization delay value indicated in certain signals transmitted by the module 106.

Figure 7:
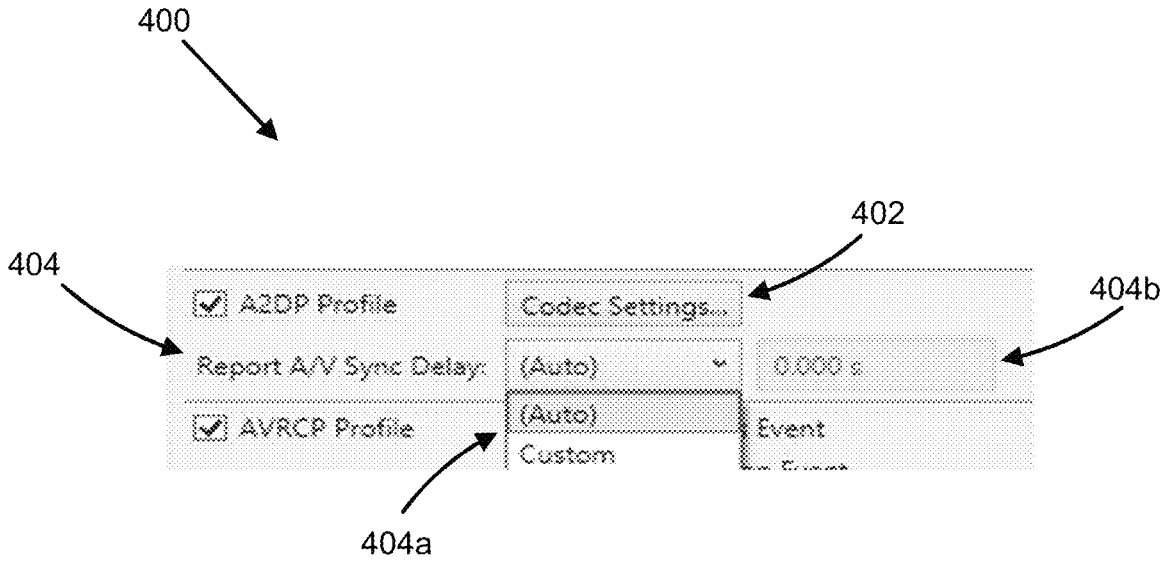
FIG. 7 depicts another example subsection element display associated with the A2DP elements subsection of FIG. 2, in accordance with various embodiments.

FIG. 7 depicts another example subsection element display 400 associated with the A2DP elements subsection 210 of FIG. 2, in accordance with various embodiments. In particular, the subsection element display 400 may be displayed within the user interface 200 (FIG. 2) in place of the features illustrated in A2DP elements subsection 210 in FIG. 2. The subsection element display 400 may be displayed when the profile set input element 202 (FIG. 2) indicates a configuration associated with a source device for the module 106 (FIG. 1).

The subsection element display 400 may include a codec settings element 402. In response to user selection of the codec settings element 402, the computer application may present display 500 (see FIG. 8). The A2DP settings prompt display may allow the user to define encoding and/or decoding settings and/or parameters for configuration of the module 106, as described further in relation to FIG. 8.

The subsection element display 400 may further include an audio/visual synchronization delay display element 404. The audio/visual synchronization delay display element 404 may allow the user to define a format in which a resultant audio/visual synchronization delay value from testing performed on the DUT 108 (FIG. 1) is displayed to the user, as is described further throughout this disclosure. The audio/visual synchronization delay display element 404 may include an auto/custom field **404*a* and/or a format display field 404*b*. When the auto value of the auto/custom field 404*a* is selected, the computer application may automatically format the resultant audio/visual synchronization delay value. When the custom value of the auto/custom field 404*a* is selected, the user may enter a format in the format display field 404*b* and the computer application may format the resultant audio/visual synchronization delay value based on the format entered in the format display field 404*b***.

Figure 8:
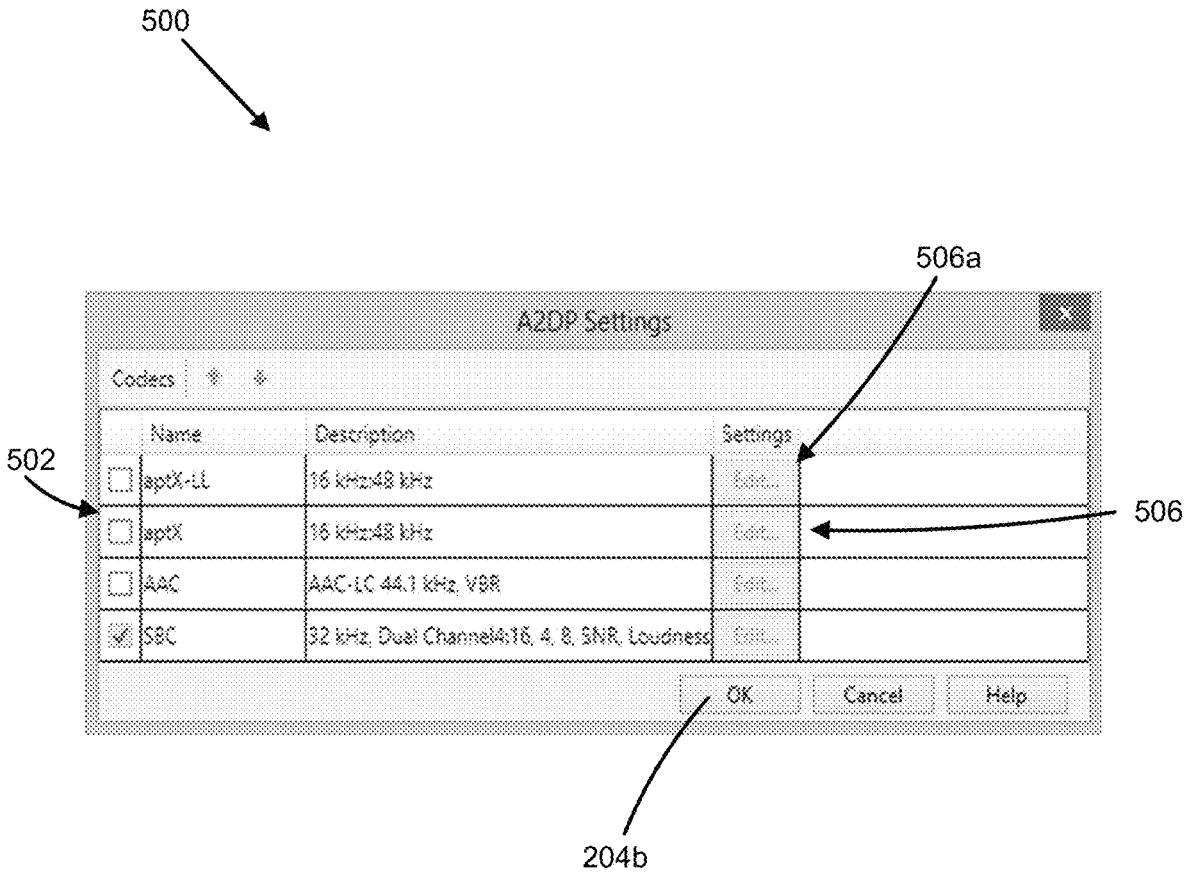
FIG. 8 depicts an example display related to codec configuration for the module of FIG. 1, in accordance with various embodiments.

FIG. 8 depicts an example display 500 related to codec configuration for the module 106 of FIG. 1, in accordance with various embodiments. The display 500 may be displayed on a display of the computer device 102 (FIG. 1). The display 500 may be displayed in response to selection of the codec settings element 302 (FIG. 6) and/or the codec settings element 402 (FIG. 7).

The display 500 may include an encoder/decoder selection element 502. The encoder/decoder selection element 502 may display a group of encoder/decoder formats that may be implemented by the module 106 and/or the DUT 108 (FIG. 1). In some embodiments, the group of encoder/decoder formats may be limited to encoder/decoder formats that may be implemented by the DUT 108 as may be determined by discovery of the DUT 108 via the module 106. The user may select an encoder/decoder format from the group of encoder/decoder formats. In response to detecting selection of an encoder/decoder format or interaction with an acceptance element (such as OK element 504), the computer application may define the configuration of the module 106 to utilize the selected encoder/decoder format.

The display 500 may further include a setting edit element 506. The setting edit element 506 may include one or more edit elements **506*a*, where each of the edit elements 506*a* correspond to a corresponding encoder/decoder format from the group of the encoder/decoder forms. In response to a user selection of one of the edit elements 506*a*, the computer application cause the computer device 102 (FIG. 1) to display a codec settings display (see the code settings display 600 (FIG. 9)) to provide further definition of the encoder/decoder format to be utilized by the module 106**.

Figure 9:
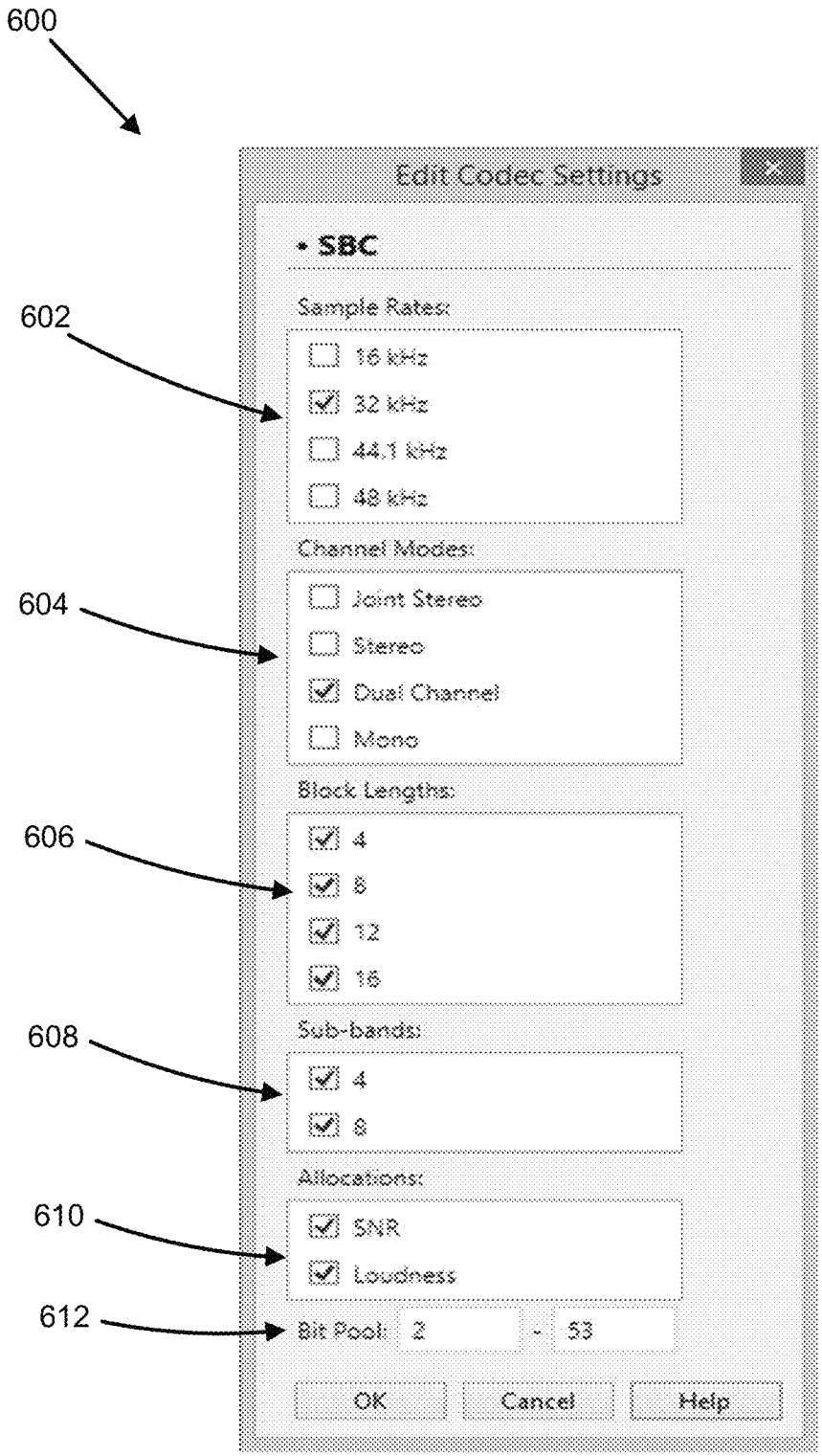
FIG. 9 depicts an example codec settings display related to codec configuration for the module of FIG. 1, in accordance with various embodiments.

FIG. 9 depicts an example codec settings display 600 related to codec configuration for the module 106 of FIG. 1, in accordance with various embodiments. The codec settings display 600 may be displayed on a display of the computer device 102 (FIG. 1). The codec settings display 600 may be displayed in response to user selection of one of the edit elements 506*a* (FIG. 8). In the illustrated example, the codec settings display 600 may have been displayed in response to selection of one of the edit elements 506*a* corresponding to an SBC encoder/decoder format. In other embodiments, the codec settings display 600 may be displayed in response to selection of the codec settings element 302 (FIG. 6) and/or the codec settings element 402 (FIG. 7) rather than the display 500 being displayed in response to selection of the codec settings element 302 (FIG. 6) and/or the codec settings element 402 (FIG. 7).

The codec settings display 600 may include a sample rate element 602. The sample rate element 602 may include a group of sample rates that the module 106 may implement. In some embodiments, the group of sample rates may be limited based on the edit element 506*a* selected by the user. For example, the group of sample rates in the illustrated embodiment may be limited to sample rates associated with the SBC encoder/decoder format based on a selection of the one of the edit elements 506*a* corresponding to the SBC encoder/decoder format. Based on selection of a sample rate from the group of sample rates, the computer application may define the configuration of the module 106 to utilize the selected sample rate.

The codec settings display 600 may include a channel mode element 604. The channel mode element 604 may include a group of channel modes that the module 106 may implement. In some embodiments, the group of channel modes may be limited based on the edit element 506*a* selected by the user. For example, the group of channel modes in the illustrated embodiment may be limited to channel modes associated with the SBC encoder/decoder format based on a selection of the one of the edit elements 506*a* corresponding to the SBC encoder/decoder format. Based on selection of a channel mode from the group of channel modes, the computer application may define the configuration of the module 106 to utilize the selected channel mode.

The codec settings display 600 may include a block length element 606. The block length element 606 may include a group of block lengths that the module 106 may implement. In some embodiments, the group of block lengths may be limited based on the edit element 506*a* selected by the user. For example, the group of block lengths in the illustrated embodiment may be limited to block lengths associated with the SBC encoder/decoder format based on a selection of the one of the edit elements 506*a* corresponding to the SBC encoder/decoder format. Based on selection of a block length from the group of block lengths, the computer application may define the configuration of the module 106 to utilize the selected block length.

The codec settings display 600 may include a sub-band element 608. The sub-band element 608 may include a group of sub-bands that the module 106 may implement. In some embodiments, the group of sub-bands may be limited based on the edit element 506*a* selected by the user. For example, the group of sub-bands in the illustrated embodiment may be limited to sub-bands associated with the SBC encoder/decoder format based on a selection of the one of the edit elements 506*a* corresponding to the SBC encoder/decoder format. Based on selection of a sub-band from the group of sub-bands, the computer application may define the configuration of the module 106 to utilize the selected sub-band.

The codec settings display 600 may include an allocation element 610. The allocation element 610 may include a group of allocations that the module 106 may implement. In some embodiments, the group of allocations may be limited based on the edit element 506*a* selected by the user. For example, the group of allocations in the illustrated embodiment may be limited to allocations associated with the SBC encoder/decoder format based on a selection of the one of the edit elements 506*a* corresponding to the SBC encoder/decoder format. Based on selection of an allocation from the group of allocations, the computer application may define the configuration of the module 106 to utilize the selected allocation.

The codec settings display 600 may include a bit pool element 612. The bit pool element 612 may allow the user to define a range of bits that the module 106 may utilize for encoding/decoding. In particular, the user may input a range of bits that the module 106 may utilize for encoding/decoding. Based on an indication of a range of bits, the computer application may define the configuration of the module 106 to utilize bits within the indicated range of bits for encoding/decoding.

Figure 10:
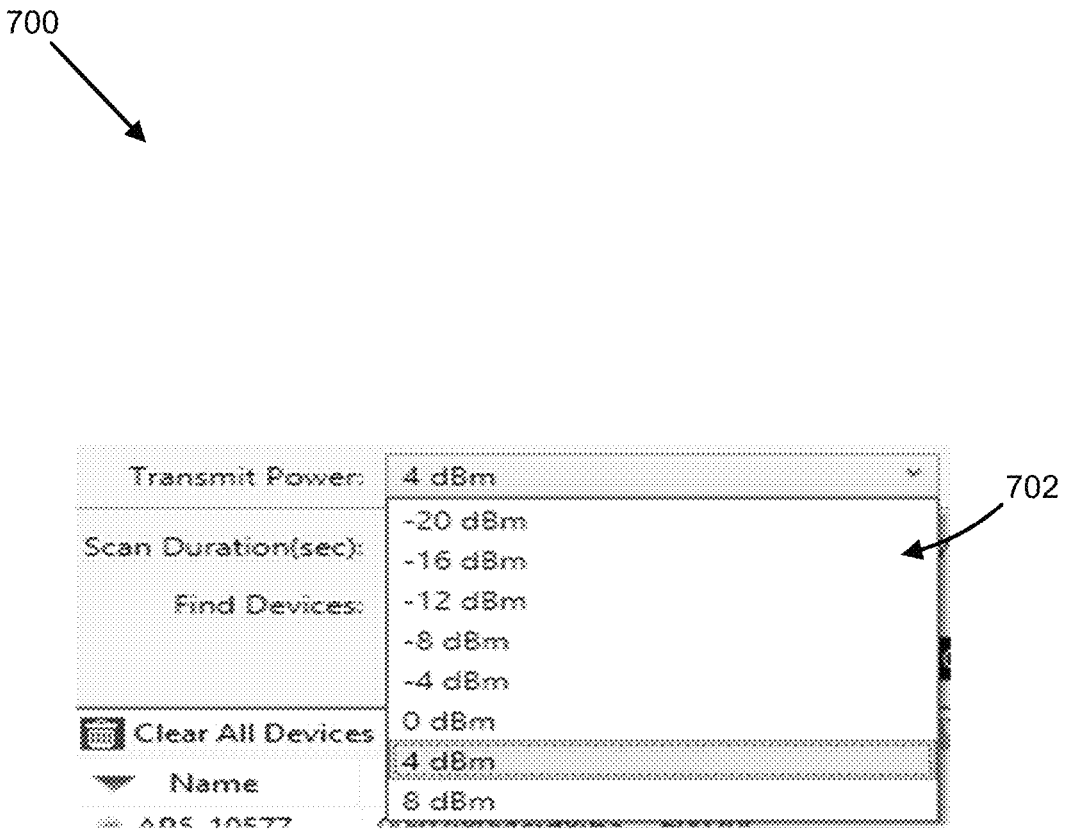
FIG. 10 depicts an example transmit power element display related to transmit power, in accordance with various embodiments.

FIG. 10 depicts an example transmit power element display 700 related to transmit power, in accordance with various embodiments. The transmit power element display 700 may be displayed within the user interface 200 (FIG. 2). The transmit power element display 700 may be displayed in response to a selection of the setting element 206 (FIG. 2) corresponding to the transmit power value 206*a* (FIG. 2) of the user interface screen 200 (FIG. 2). The transmit power element display 700 may include a transmit power selection element 702. The transmit power selection element 702 may include a group of transmit powers that may be utilized by the module 106 (FIG. 1) for transmissions via wireless communication. In particular, the transmit powers may define a power level for electrical signals transmitted by the module 106. The user may select one of the transmit powers from the group of transmit powers to be utilized by the module 106. Based on the selection of transmit power from the group of transmit powers, the computer application may define the configuration of the module 106 to utilize the selected transmit power.

Figure 11:
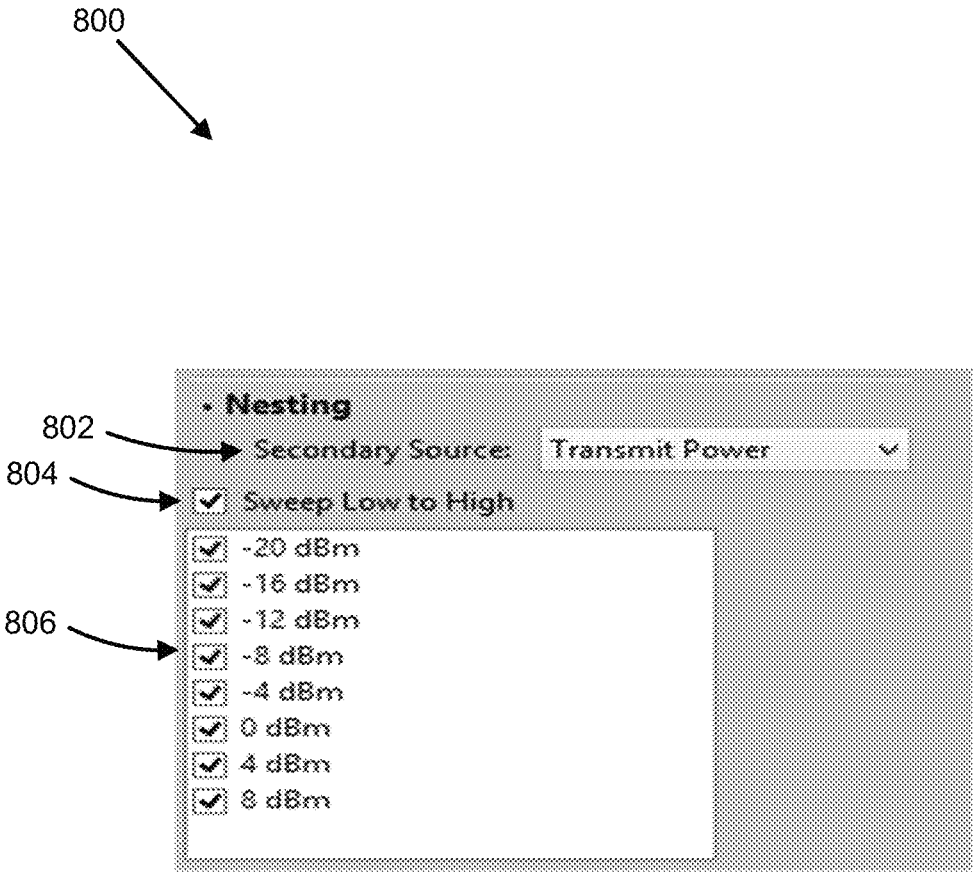
FIG. 11 depicts an example nested sweep display, in accordance with various embodiments.

FIG. 11 depicts an example nested sweep display 800, in accordance with various embodiments. The nested sweep display 800 may provide for a user selection that allows the computer application to repeat a process or function over multiple iterations while adjusting a parameter associated with the process or the function on each iteration. The adjustment procedure and algorithm may be referred to as a sweep. The adjustment procedure while repeating an analysis process may be referred to as a nested sweep.

The nested sweep display 800 may be displayed on a display of the computer device 102 (FIG. 1). In the illustrated embodiment, the nested sweep display 800 is illustrated for a transmit power sweep procedure. The nested sweep display 800 may be displayed in response to an indication in the computer application that the module 106 (FIG. 1) is to perform a sweep procedure, such as the transmit power sweep procedure.

The nested sweep display 800 may include a sweep parameter element 802. The sweep parameter element 802 may allow the user to define a parameter that is to be swept during testing. In the illustrated embodiment, the parameter to be swept in the sweep parameter element 802 is transmit power. The features and/or elements included within the nested sweep display 800 may be based on the parameter to be swept. In particular, the illustrated embodiment includes features and/or elements associated with the transmit power based on the defined parameter being transmit power.

The nested sweep display 800 may include a sweep order element 804. The sweep order element 804 may allow an order of testing of values for the parameter that the module 106 is to sweep through during testing. For example, the order may define that the module 106 is to begin testing with a lowest value of the sweep values and step through the sweep values from the lowest value of the sweep values increasing to the highest value of the sweep values. In the illustrated embodiment, the order may default to a highest value to lowest value sweep order. In response to the sweep order element 804 being enabled, the computer application may change the order from the default order to a lowest value to highest value sweep order. In other embodiments, the default order and the order corresponding to the enablement of the sweep order element 804 may be swapped. Further, in other embodiments, there may not be a default order and the sweep order element 804 may include one or more selections to define the order of the sweep. Based on the defined order, the computer application may define the configuration of the module 106 to utilize the defined order.

The nested sweep display 800 may further include a sweep values element 806. The sweep values element 806 may include a group of values that the module 106 may sweep through during testing. In the illustrated embodiment, the sweep values element 806 includes a group of transmit power values that the module 106 may sweep through during testing. The user may define which transmit power values from the group of transmit power values the module 106 is to sweep through during testing. Based on the selection of transmit power values from the group of transmit power values, the computer application may define the configuration of the module 106 to sweep through the selected transmit power values during testing.

Figure 12:
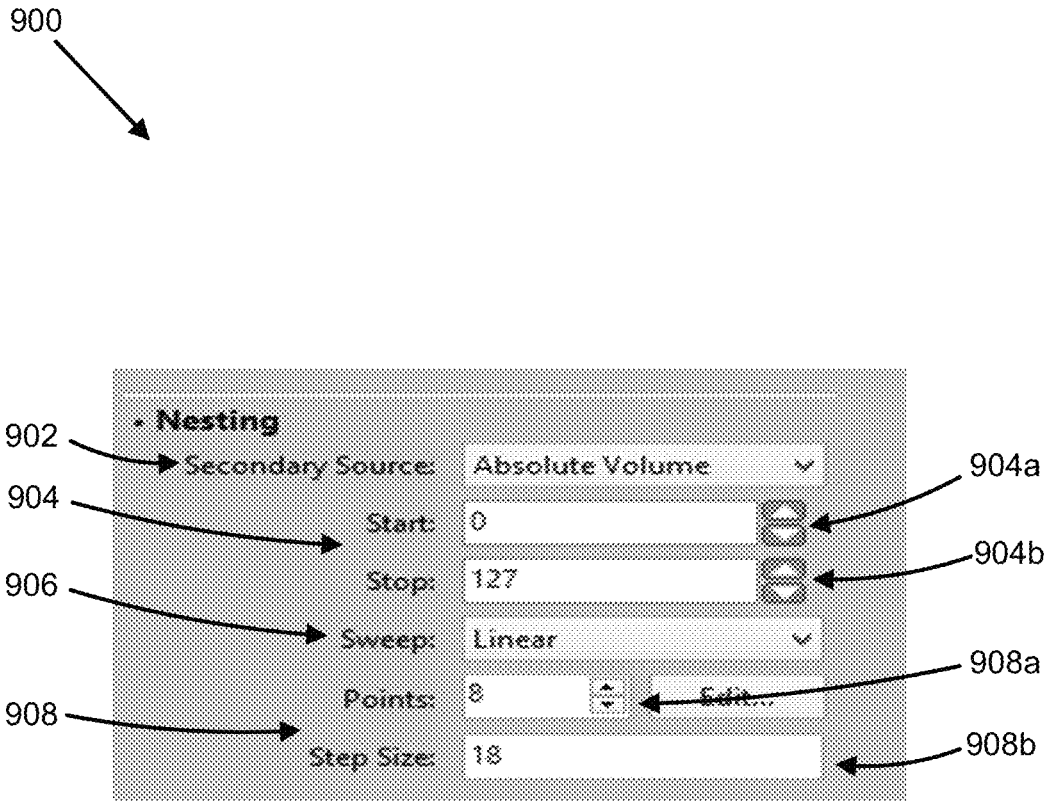
FIG. 12 depicts another example nested sweep display, in accordance with various embodiments.

FIG. 12 depicts another example nested sweep display 900, in accordance with various embodiments. The nested sweep display 900 may be displayed on a display of the computer device 102 (FIG. 1). In the illustrated embodiment, the nested sweep display 900 is illustrated for an absolute volume sweep procedure. The nested sweep display 900 may be displayed in response to an indication in the computer application that the module 106 (FIG. 1) is to perform a sweep procedure, such as the absolute volume sweep procedure.

The nested sweep display 900 may include a sweep parameter element 902. The sweep parameter element 902 may allow the user to define a parameter that is to be swept during testing. In the illustrated embodiment, the parameter to be swept in the sweep parameter element 902 is absolute volume. The features and/or elements included within the nested sweep display 800 may be based on the parameter to be swept. In particular, the illustrated embodiment includes features and/or elements associated with the absolute volume based on the defined parameter being absolute volume.

The nested sweep display 900 may further include a sweep range element 904. The sweep range element 904 may allow the user to define a range of values that the module 106 is to sweep through during testing. The sweep range element 904 may include a sweep start field 904*a* and a sweep stop field 904*b* to define the range of values. In particular, the module 106 may be to start testing at the value indicated in the sweep start field 904*a* and step through the range of values until reaching the value indicated in the sweep stop field 904*b*. Based on the defined range of values, the computer application may define the configuration of the module 106 to sweep within the range of values during testing.

The nested sweep display 900 may further include a sweep progression element 906. The sweep progression element 906 may allow the user to define how the module 106 proceeds through the range of values during testing. In particular, the sweep progression element 906 may allow the user to define that the module 106 is to sweep through the range of values in a linear fashion, a logarithmic fashion, an exponential fashion, or other similar fashions of progression through a range of values. Based on the defined progression, the computer application may define the configuration of the module 106 to progress through the range of values in accordance with the defined progression during testing.

The nested sweep display 900 may further include a progression parameter element 908. The features and/or elements included in the progression parameter element 908 may be based on the progression defined by the user indicated within the sweep progression element 906. In the illustrated embodiment, the features and/or elements included in the progression parameter element 908 may be associated with a linear fashion of progression based on linear being indicated within the sweep progression element 906. In other embodiments, the features and/or elements included progression parameter 908 may correspond to other progressions indicated in the sweep progression element 906 and may be different from the features and/or elements in the illustrated embodiment.

The progression parameter element 908 may include a points element 908*a*, a step size element 908*b*, or some combination thereof. The points element 908*a* may allow the user to define an amount of values within the range of values that the module 106 is to apply during testing. For example, if the value within the points element 908*a* is 8, the module 106 may sweep through 8 different values within the range of values in accordance with the sweep progression. The computer application may update a value within the step size element 908*b* in response to detecting that the value in the points element 908*a* has been changed. In other embodiments, the value in the step size element 908*b* may not be updated based on detecting a change in the value in the points element 908*a*.

The step size element 908*b* may allow the user to define a difference between consecutive values that the module 106 is to apply during testing. For example, if the value in the step size element 908*b* is 18 and the value in the sweep start field 904*a* is 0, the module 106 may start testing with a test value of zero and test the DUT 108, may increase the test value by 18 to 18 and again test the DUT 108, and so forth. The computer application may update a value within the points element 908*a* in response to detecting that the value in the step size element 908*b* has been changed. In other embodiments, the value in the points element 908 may not be updated based on detecting a change in the step size element 908*b*. Based on the values within the points element 908*a* and the step size element 908*b*, the computer application may define the configuration of the module 106 to utilize the indicated number of points in the points element 908*a* and the step size in the step size element 908*b*.

Figure 13:
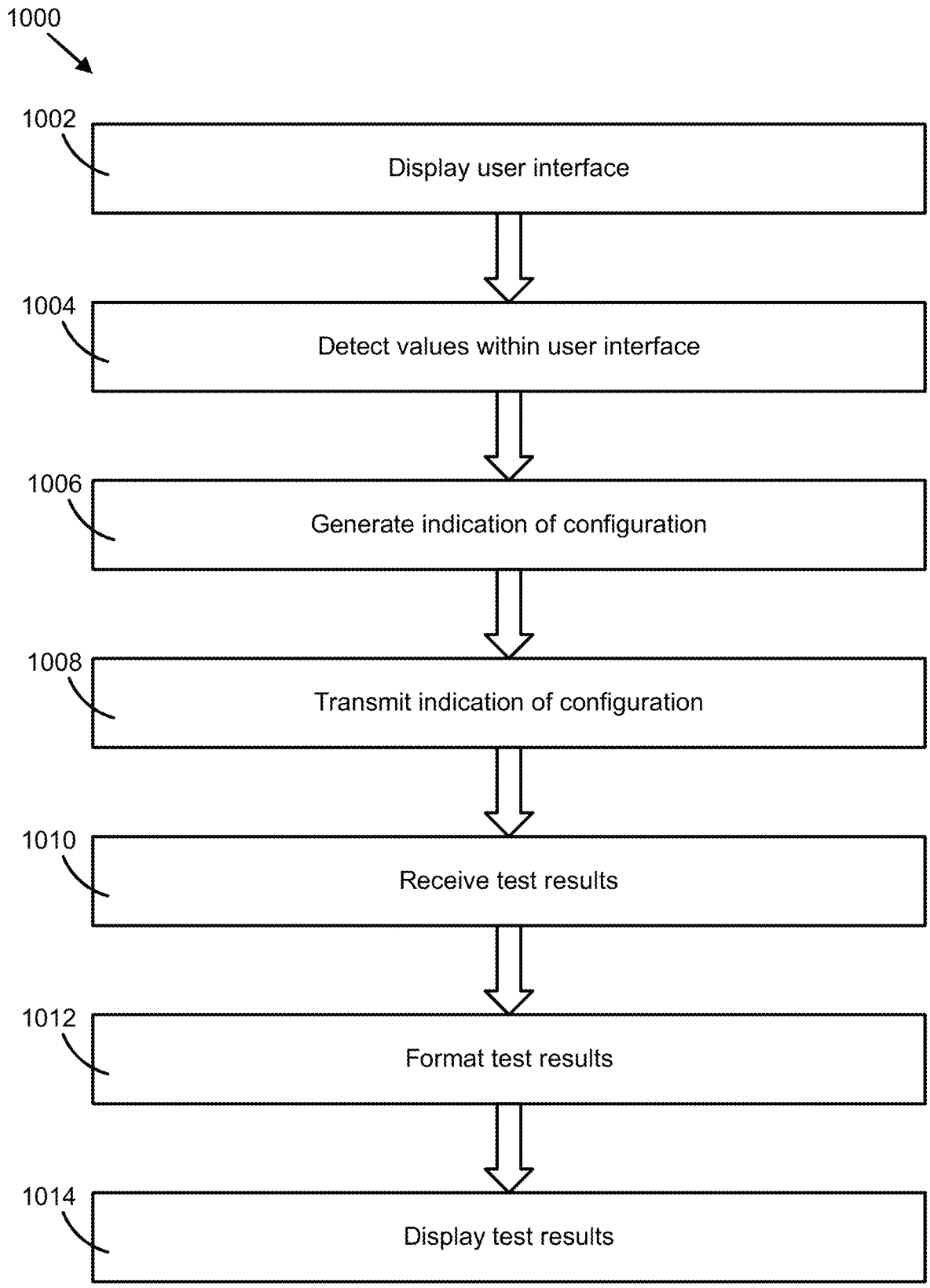
FIG. 13 illustrates an example procedure to be performed by the computer device of FIG. 1, in accordance with various embodiments.

FIG. 13 illustrates an example procedure 1000 to be performed by the computer device 102 of FIG. 1, in accordance with various embodiments. The procedure 1000 may be initiated in response to the computer application associated with the analyzer 104 (FIG. 1) being launched, a certain selection within the computer application, or some combination thereof.

The procedure 1000 may initiate with stage 1002. In stage 1002, the computer device 102 may display the user interface 200 (FIG. 2) on the display of the computer device 102. The user may interact with one or more of the elements within the user interface 200, wherein "the elements" may refer to the profile set input element 202, the configuration setting elements 204, the setting elements 206, and the detected device list elements 208. Further, the computer device 102 may display the subsection element display 300 (FIG. 6), the subsection element display 400 (FIG. 7), the display 500 (FIG. 8), the codec settings display 600 (FIG. 9), the transmit power element display 700 (FIG. 10), the nested sweep display 800 (FIG. 11), the nested sweep display 900 (FIG. 12), or some combination thereof, based on user interaction with the user interface 200. In response to detection of a trigger (such as an indication that the analyzer 104 and/or the module 106 (FIG. 1) is to initiate testing) by the computer device 102, the procedure 1000 may proceed to stage 1004.

In stage 1004, the computer device 102 may detect values indicated within the user interface 200, the subsection element display 300, the subsection element display 400, the display 500, the codec settings display 600, the transmit power element display 700, the nested sweep display 800, the nested sweep display 900, or some combination.

In stage 1006, the computer device 102 may generate an indication of a configuration for the module 106. In particular, the computer device 102 may generate the indication of the configuration for the module 106 based on the values detected in stage 1004.

In stage 1008, the computer device 102 may transmit the indication of the configuration for the module 106 to the analyzer 104. The procedure 1000 may proceed to stage 1010 in response to transmission of the indication.

In stage 1010, the computer device 102 may wait to receive test results from the analyzer 104. In particular, the analyzer 104 and/or the module 106 may perform testing of the DUT 108 (FIG. 1) after stage 1008. Upon receipt of the test results, the procedure 1000 may proceed to stage 1012.

In stage 1012, the computer device 102 may format the test results received in stage 1010. Formatting of the test results may be based on the testing performed by the analyzer 104 and/or the module 106, the values detected in stage 1004, values of the test results, or some combination thereof. Formatting of the test results may include generating one or more representations of the test results to be displayed on the computer device 102. The representations may include any representation of test results known to one having ordinary skill in the art, such as pass/fail representations of the test results, table representations of the test results, graphical representations of the test results, or some combination thereof.

In stage 1014, the computer device 102 may display the representations of the test results on a display of the computer device 102. In particular, the representations of the test results may be displayed within a user interface of the computer application associated with the analyzer 104.

While the procedure 1000 is described as being performed by the computer device 102, it is to be understood that some portion or an entirety of the procedure 1000 may be performed by the analyzer 104. For example, in embodiments where the computer device 102 is omitted and the analyzer 104 includes one or more of the features of the computer device 102 and/or performs one or more of the operations of the computer device 102, the analyzer 104 may perform the procedure 1000 rather than the computer device 102 performing the procedure 1000.

Figure 14:
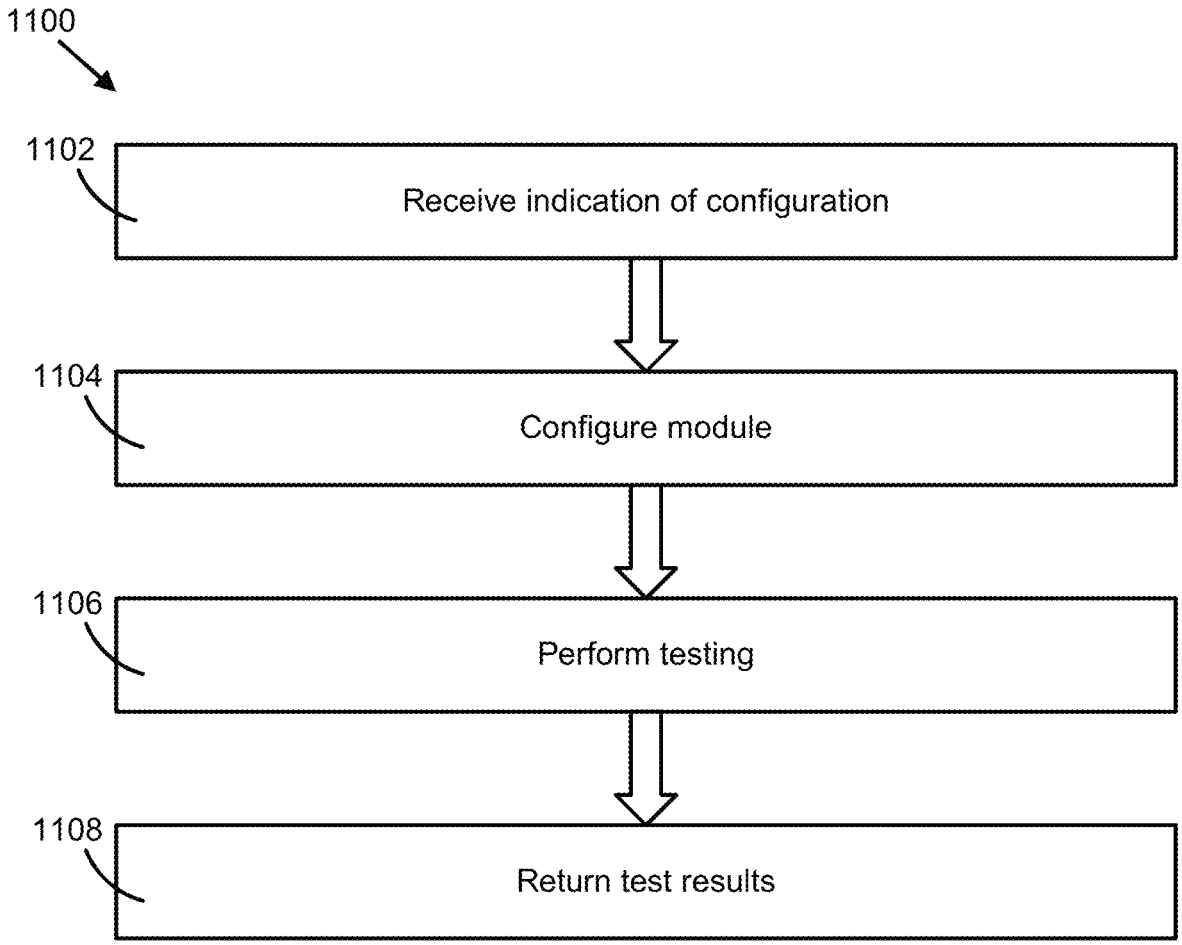
FIG. 14 illustrates an example procedure to be performed by the analyzer and/or the module of FIG. 1, in accordance with various embodiments.

FIG. 14 illustrates an example procedure 1100 to be performed by the analyzer 104 and/or the module 106 of FIG. 1, in accordance with various embodiments. In particular, the procedure 1100 may be initiated in response to receiving the indication of the configuration for the module 106 from the computer device 102 (FIG. 1) that is transmitted in stage 1008 (FIG. 13) of procedure 1000 (FIG. 13). In stage 1102, the analyzer 104 may receive the indication of the configuration from the computer device 102. In response to receiving the indication of the configuration, the procedure 1100 may proceed to stage 1104.

In stage 1104, the module 106 may be configured in accordance with the indication of the configuration. In particular, the analyzer 104, the module 106, or some combination thereof, may configure the module 106 in accordance with the indication of the configuration. Configuring the module 106 may include configuring the module 106 to act as a source device or a rendering device, setting a encoding/decoding protocol to be utilized by the module, identifying devices the module 106 is to test (such as the DUT 108 (FIG. 1)), defining tests to be performed by the module 106, defining one or more settings and/or parameters to be utilized for testing performed by the module 106, causing the module 106 to adopt a profile associated with the configuration, or some combination thereof. Further, configuring the module 106 may include configuring a chipset of the module 106 based on the indication of the configuration. The chipset of the module 106 being configured may be utilized for wireless communication by the module 106. Once the module 106 has been configured, the procedure 1100 may proceed to stage 1106.

In stage 1106, analyzer 104 and/or the module 106 may perform testing of a DUT, such as the DUT 108. In particular, the module 106 may wirelessly communicate with the DUT and may initiate testing, via wireless communication, of the DUT. In some embodiments, the module 106 may utilize one or more of the resources of the analyzer 104 while performing testing. For example, the module 106 may utilize an encoder and/or decoder of the analyzer 104 for encoding/decoding in certain encoder/decoder standard, such as the advanced audio codec (AAC) standard.

Some tests that may be performed in stage 1106 are described further in relation to FIGS. 15-21. It is to be understood that the tests described is a non-exclusive lists of tests that may be performed by the module 106. The testing performed by the module 106 may produce test results that may be captured by the module 106. In some embodiments, test results may further be captured by the analyzer 104, another module within the analyzer 104, the computer device 102, or some combination thereof. For example, the testing may cause the DUT to produce a sound, where a microphone of the analyzer 104 may capture the sound for analysis to produce test results. Once the testing is completed, the procedure 1100 may proceed to stage 1108.

In stage 1108, the analyzer 104 and/or the module 106 may return the test results to the computer device 102. In particular, test results captured by the analyzer 104 and/or the module 106 may be transmitted to the computer device 102 via the analyzer 104. The test results may be received by the computer device 102 in stage 1010 (FIG. 13) of the procedure 1000 (FIG. 13).

Figure 15:
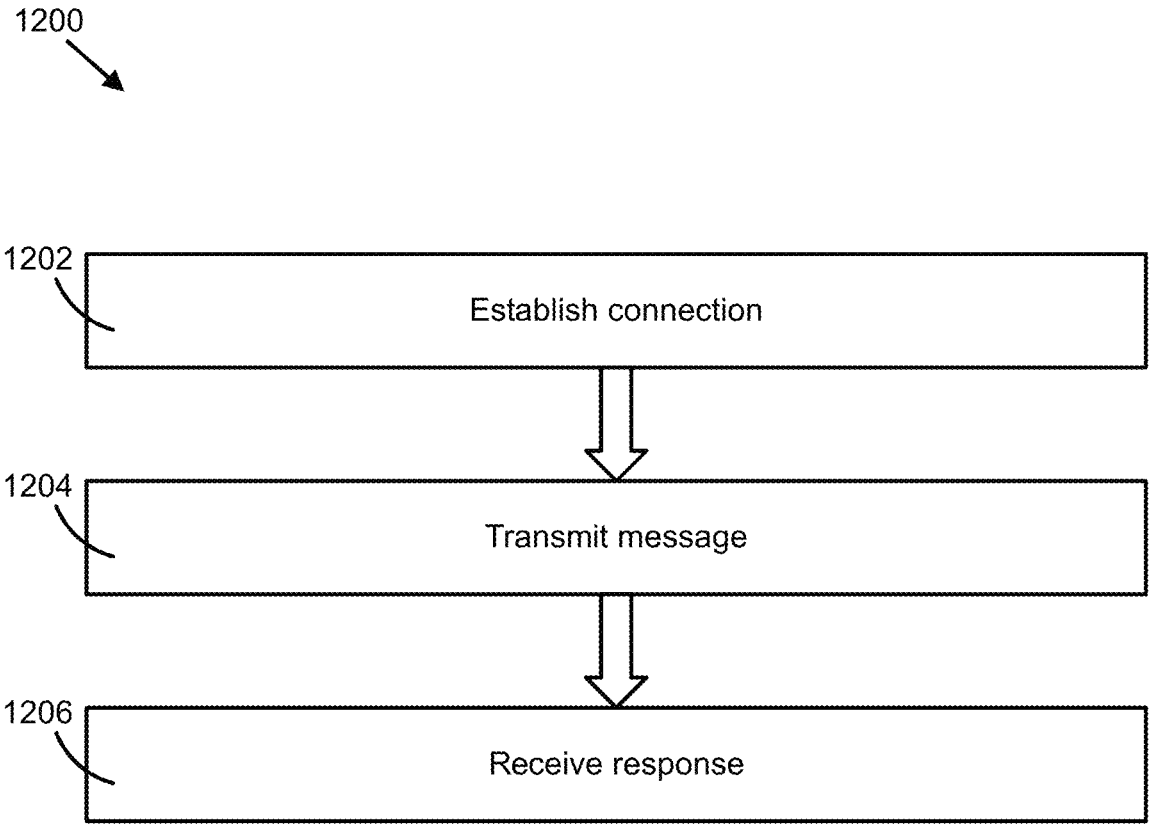
FIG. 15 illustrates an example test procedure associated with playback status and playback position, in accordance with various embodiments.

FIG. 15 illustrates an example test procedure 1200 associated with playback status and playback position, in accordance with various embodiments. The test procedure 1200 may be performed in stage 1106 (FIG. 14) of procedure 1100 (FIG. 14). The module 106 (FIG. 1) may be configured as a source device in the procedure 1200. Further, the DUT 108 (FIG. 1) may be a rendering device in procedure 1200.

In stage 1202, the module 106 may establish a connection with the DUT 108. Establishing the connection may include a handshake procedure between the module 106 and the DUT 108. The handshake procedure may include the module 106 requesting a wireless connection with the DUT 108 and the DUT 108 responding with acceptance of the wireless connection, which may include information for wirelessly communicating with the DUT 108. Once the wireless connection is established, the procedure 1200 may proceed to stage 1204. In other embodiments, a wireless connection may already be established between the module 106 and the DUT 108, in which case stage 1202 may be omitted.

In stage 1204, the module 106 may transmit a signal to the DUT 108 with a simulated playback status and/or a simulated playback position. The simulated playback status and/or the simulated playback position may be generated by the module 106, the computer device 102 (FIG. 1), or some combination thereof. The simulated playback status may be to imitate a playback status (i.e. playing, paused, or stopped) that would be produced by a source device playing media. Further, the simulated playback position may be to imitate a current playback position (i.e. current time stamp or current progress percentage) that would be produced by a source device playing media. The simulated playback status and/or the simulated playback position may be included in the signal based on the configuration of the module 106 performed in stage 1106 of procedure 1100. The signal may further include a request for a response from the DUT 108 that includes the simulated playback status and/or the simulated playback position.

In stage 1206, the module 106 may receive the response from the DUT 108. The module 106 may verify that the response includes the simulated playback status and/or the simulated playback position, may verify values of the simulated playback status and/or the simulated playback position, or some combination thereof. The module 106 may return, via the analyzer 104, the results of the verification to the computer device 106 in stage 1108 (FIG. 14) of procedure 1100. In other embodiments, the module 106 may return, via the analyzer 104, the response received from the DUT 108 to the computer device 102 for verification of presence and/or values of the simulated playback status and/or the simulated playback position by the computer device 102.

Figure 16:
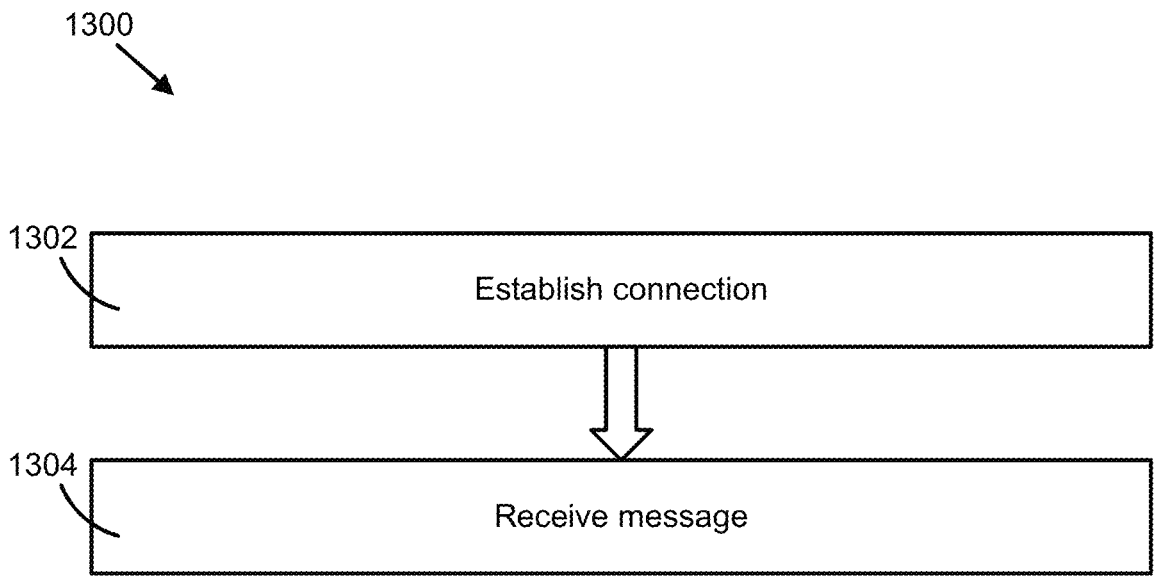
FIG. 16 illustrates another example test procedure associated with playback status and playback position, in accordance with various embodiments.

FIG. 16 illustrates another example test procedure 1300 associated with playback status and playback position, in accordance with various embodiments. The test procedure 1300 may be performed in stage 1106 (FIG. 14) of procedure 1100 (FIG. 14). The module 106 (FIG. 1) may be configured as a rendering device in procedure 1300. Further, the DUT 108 (FIG. 1) may be a source device in procedure 1300.

In stage 1302, the module 106 may establish a connection with the DUT 108. Establishing the connection may include a handshake procedure between the module 106 and the DUT 108. The handshake procedure may include the DUT 108 requesting a wireless connection with the module 106 and the module 106 responding with acceptance of the wireless connection, which may include information for wirelessly communicating with the module 106. Once the wireless connection is established, the procedure 1300 may proceed to stage 1304. In other embodiments, a wireless connection may already be established between the module 106 and the DUT 108, in which case stage 1302 may be omitted.

In stage 1304, the DUT 108 may transmit a signal to the module 106 with a playback status and/or a playback position of media that the DUT 108 is currently transmitting, wherein the media would be rendered by a rendering device based on the transmission if the DUT 108 was coupled to a rendering device rather than the module 106. In some embodiments, the DUT 108 may transmit the signal in response to the DUT 108 receiving a signal from the module 106 requesting the playback status and/or the playback position. The playback status and/or the playback position may be generated by the DUT 108. The playback status may indicate that the media is playing, paused, or stopped. Further, the playback position may indicate a current playback position (such as by a current time stamp or current progress percentage) of the media being transmitted by the DUT 108.

In stage 1306, the module 106 may compare the received playback status and/or playback position to an actual playback status and/or playback position. The actual playback status and/or playback position may be determined by the analyzer 104, another module within the analyzer 104, the computer device 106, or some combination thereof. The module 106 may generate test results based on the comparison of the received playback status and/or playback position with the actual playback status and/or playback position. The module 106 may return, via the analyzer 108, the test results to the computer device 102 in stage 1108 (FIG. 14) of the procedure 1100 (FIG. 14). In other embodiments, the module 106 may return, via the analyzer 104, the signal received with the received playback status and/or playback position to the computer device 102 for comparison with the actual playback status and/or playback position. Further, in other embodiments, the test results may be produced based on the presence of the playback status and/or playback position and the comparison with the actual playback status and/or playback position may be omitted.

Figure 17:
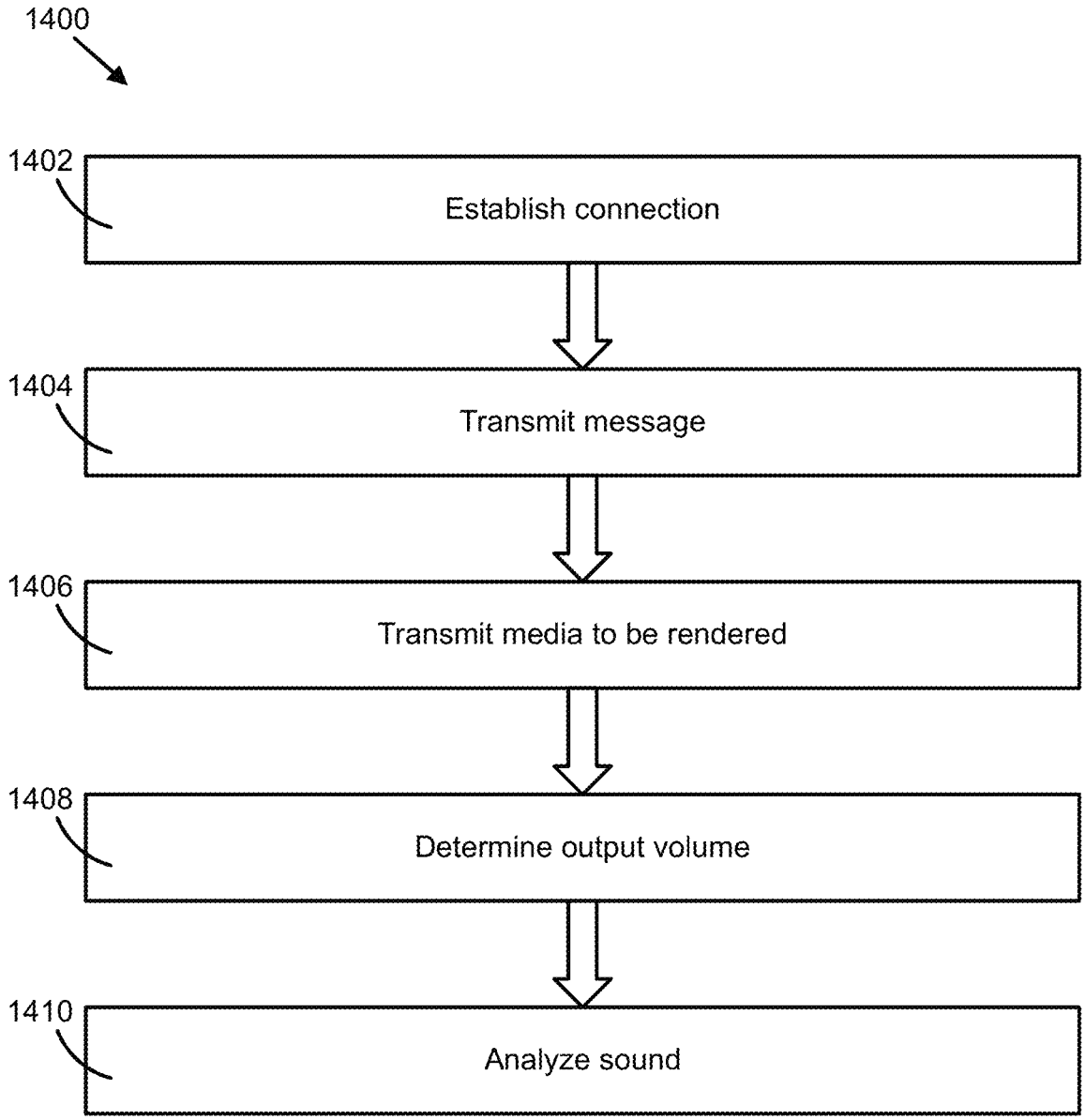
FIG. 17 illustrates another example test procedure associated with absolute volume, in accordance with various embodiments.

FIG. 17 illustrates another example test procedure 1400 associated with absolute volume, in accordance with various embodiments. Absolute volume may refer to a procedure where a source device and a rendering device communicate with each other to determine a volume for playback of media and determine which device, or how much each device, will scale a magnitude of the media to produce the volume. In legacy systems that did not have absolute volume controls, the source device and the rendering device could independently scale the magnitude of the media, often resulting in a volume for the playback of the media that neither the source device or the rendering device were aware of In these legacy systems, a user may have to adjust the volume controls at both the source device and the rendering device to achieve the desired volume for the playback of the media.

The test procedure 1400 may be performed in stage 1106 (FIG. 14) of procedure 1100 (FIG. 14). The module 106 (FIG. 1) may be configured as a source device in procedure 1400. Further, the DUT 108 (FIG. 1) may be a rendering device in procedure 1400.

In stage 1402, the module 106 may establish a connection with the DUT 108. Establishing the connection may include a handshake procedure between the module 106 and the DUT 108. The handshake procedure may include the module 106 requesting a wireless connection with the DUT 108 and the DUT 108 responding with acceptance of the wireless connection, which may include information for wirelessly communicating with the DUT 108. Once the wireless connection is established, the procedure 1400 may proceed to stage 1404. In other embodiments, a wireless connection may already be established between the module 106 and the DUT 108, in which case stage 1402 may be omitted.

In stage 1404, the module 106 may transmit a signal including absolute volume parameters to the DUT 108. The absolute volume parameters may include value of the absolute volume for the playback of the media, an amount of scaling of the magnitude of the media to be performed by the module 106, an amount of scaling of the magnitude of the media to be performed by the DUT 108, or some combination thereof. After transmission of the signal, the procedure 1400 may proceed to stage 1406.

In stage 1406, the module 106 may transmit a signal associated with media to be rendered (i.e. producing sound associated with the signal) by the DUT 108. In response to receiving the signal, the DUT 108 may produce the sound associated with the signal.

In stage 1408, an output volume of the sound produced by the DUT 108 may be determined. Stage 1408 may be performed while the signal is still being transmitted in stage 1406 or after the signal has been transmitted. The output volume may be determined by the analyzer 104, another module within the analyzer 104, the computer device 102 (FIG. 1), or some combination thereof. For example, the computer device 102 may capture the sound via a microphone of the analyzer 104 and determine the output volume based on the determined sound.

In instances where the module 106 is configured to perform a nested sweep procedure, the procedure 1400 may repeat stages 1404-1408 for the absolute volume values to be swept through in the nested sweep procedure. In particular, the procedure 1400 may continue to repeat stages 1404-1408 until output volume of the sound produced by the DUT 108 associated with the stop value (which may be indicated by a value within the sweep stop field 904*b* (FIG. 12)) is determined.

In instances where the module is configured not to perform a nested sweep procedure or nested sweep procedure has been completed, the procedure 1400 may proceed to stage 1410. In stage 1410, the module 106 may analyze the determined output volume or output volumes to determine whether the DUT 108 produced the proper absolute volume. The module 106 may produce test results based on the analysis. The test results may be returned, via the analyzer 104, to the computer device 102 in stage 1108 (FIG. 14) of procedure 1100 (FIG. 14). In other embodiments, representations of the captured sound or captured sounds may be returned, via the analyzer 104, to the computer device 102 for analysis in stage 1108, in which case stage 1410 may be omitted. Further, in other embodiments, the sound may have been captured by the computer device 102 and the computer device 102 may analyze the captured sound, in which case stage 1410 may be omitted.

Figure 18:
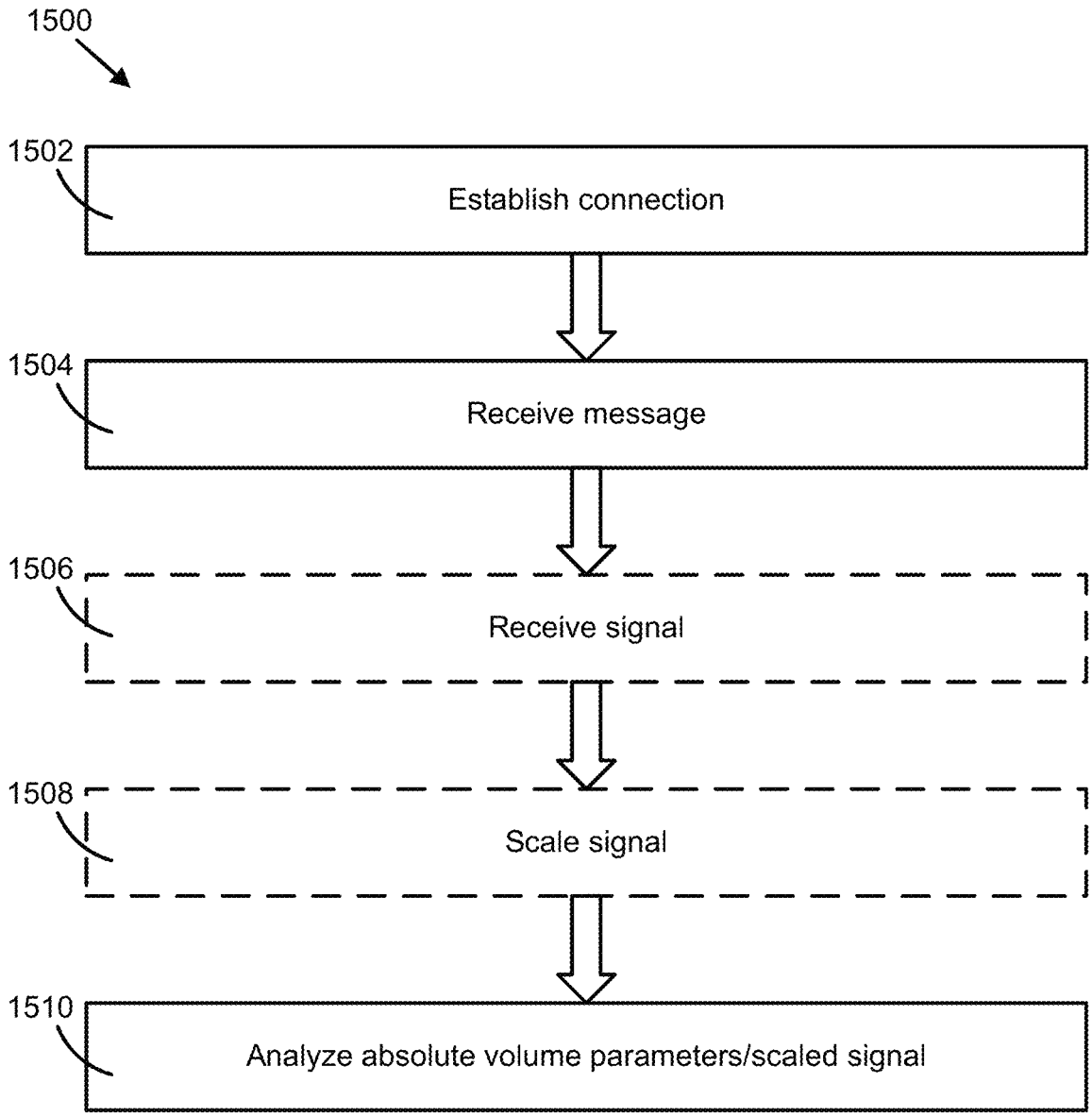
FIG. 18 illustrates another example test procedure associated with absolute volume, in accordance with various embodiments.

FIG. 18 illustrates another example test procedure 1500 associated with absolute volume, in accordance with various embodiments. The test procedure 1500 may be performed in stage 1106 (FIG. 14) of procedure 1100 (FIG. 14). The module 106 (FIG. 1) may be configured as a rendering device in procedure 1500. Further, the DUT 108 (FIG. 1) may be a source device in procedure 1500.

In stage 1502, the module 106 may establish a connection with the DUT 108. Establishing the connection may include a handshake procedure between the module 106 and the DUT 108. The handshake procedure may include the DUT 108 requesting a wireless connection with the module 106 and the module 106 responding with acceptance of the wireless connection, which may include information for wirelessly communicating with the module 106. Once the wireless connection is established, the procedure 1500 may proceed to stage 1504. In other embodiments, a wireless connection may already be established between the module 106 and the DUT 108, in which case stage 1502 may be omitted.

In stage 1504, the module 106 may receive a signal including absolute volume parameters from the DUT 108. The absolute volume parameters may include value of the absolute volume for the playback of the media, an amount of scaling of the magnitude of the media to be performed by the module 106, an amount of scaling of the magnitude of the media to be performed by the DUT 108, or some combination thereof. In some embodiments where the module is configured to scale a signal associated with media received from the DUT 108, the procedure 1500 may proceed to stage 1506. In some embodiments where the module is not configured to scale the signal, the procedure may proceed to stage 1510.

In stage 1506, the module 106 may receive a signal associated with media from the DUT 108. In response to reception of the signal, the procedure 1500 may proceed to stage 1508.

In stage 1508, the module 106 may scale the signal received from the DUT 108 based on the absolute volume parameters received in the signal is stage 1504. In particular, the module 106 may scale the signal in accordance with the amount of scaling of the magnitude of the media to be performed by the module included in the signal. In response to completion of the scaling, the procedure 1500 may proceed to stage 1510.

In stage 1510, the module 106 may analyze the absolute volume parameters and/or the scaled signal to determine whether the DUT 108 provided the proper absolute volume parameters. The module 106 may produce test results based on the analysis. The module 106 may return, via the analyzer 104, the test results to the computer device 102 in stage 1108 (FIG. 14) of the procedure 1100 (FIG. 14). In other embodiments, the module 106 may return, via the analyzer 104, the absolute volume parameters and/or the scaled signal as test results to the computer device 102 for the computer device 102 to perform the analysis, in which case stage 1510 may be omitted.

Figure 19:
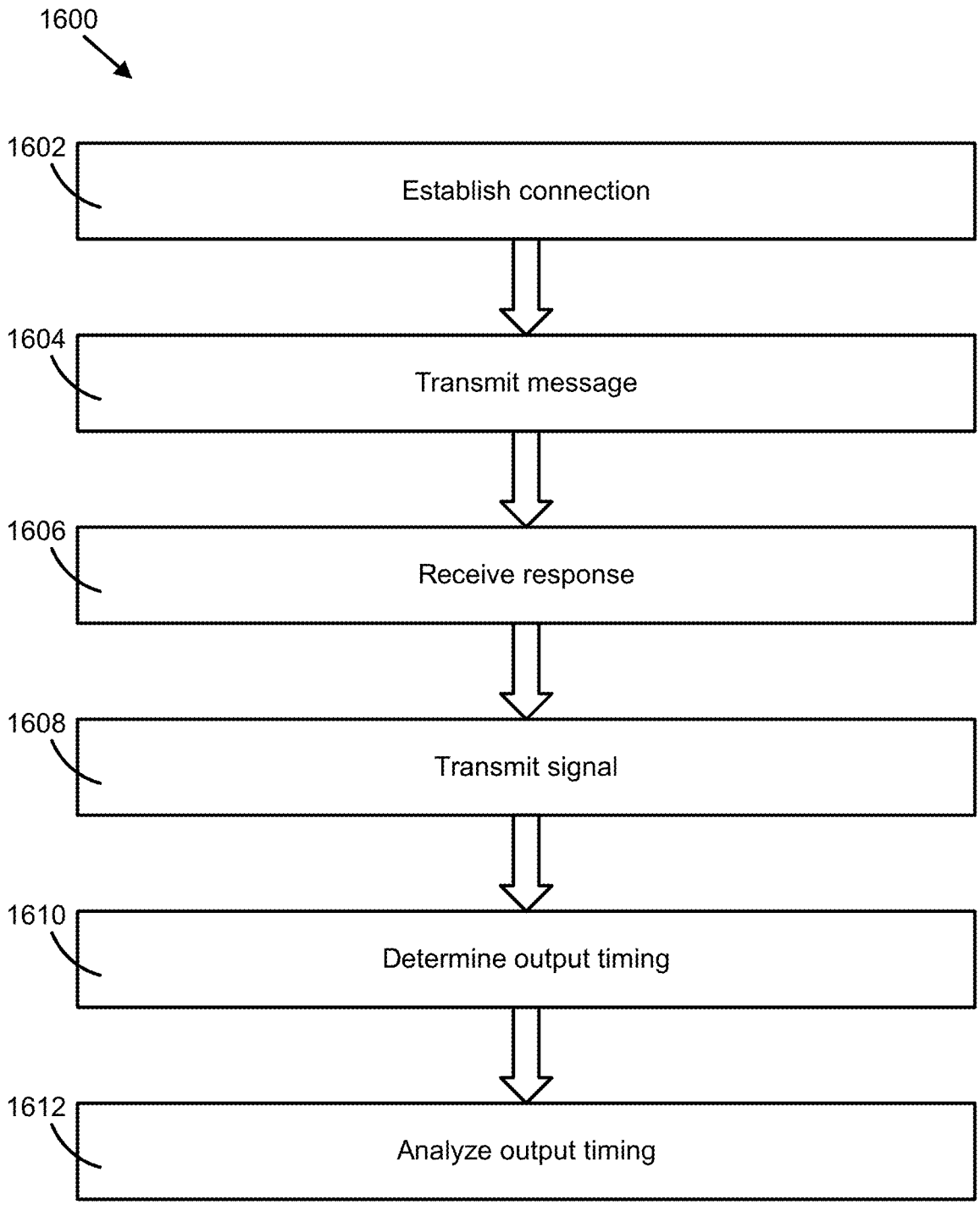
FIG. 19 illustrates another example test procedure associated with audio/visual synchronization delay, in accordance with various embodiments.

FIG. 19 illustrates another example test procedure 1600 associated with audio/visual synchronization delay, in accordance with various embodiments. Audio/visual synchronization delay may be present where the source device is to render a visual portion of media while the rendering device is to render an audio portion of the media. The rendering of the audio portion of the media may be delayed due to transmission time of an audio signal associated with media from the source device to the rendering device, encoding of the audio signal via the source device, decoding of the audio signal via the rendering device, or some combination thereof. In legacy systems, this would result cause the in the visual portion of the media being rendered prior to the audio portion, and the visual portion and the audio portion being unmatched in rendering time. Some systems have implemented a process of delaying the rendering of the visual portion to match the rendering time of the visual portion and the audio portion. Test procedure 1600 may be implemented for testing systems where the rendering of the visual portion is delayed.

The test procedure 1600 may be performed in stage 1106 (FIG. 14) of procedure 1100 (FIG. 14). The module 106 (FIG. 1) may be configured as a source device in procedure 1600. Further, the DUT 108 (FIG. 1) may be a rendering device in procedure 1600.

In stage 1602, the module 106 may establish a connection with the DUT 108. Establishing the connection may include a handshake procedure between the module 106 and the DUT 108. The handshake procedure may include the module 106 requesting a wireless connection with the DUT 108 and the DUT 108 responding with acceptance of the wireless connection, which may include information for wirelessly communicating with the DUT 108. Once the wireless connection is established, the procedure 1600 may proceed to stage 1604. In other embodiments, a wireless connection may already be established between the module 106 and the DUT 108, in which case stage 1602 may be omitted.

In stage 1604, the module 106 may transmit a signal requesting a synchronization delay time from the DUT 108. In response to transmission of the signal, the procedure 1600 may proceed to stage 1606.

In stage 1606, the module 106 may receive a response with the synchronization delay time from the DUT 108. The synchronization delay time may be determined by the DUT 108 based on a transmission time/encoding time of the signal in stage 1604 (which may be determined based on a time stamp included in the signal and a time of reception of the signal), a decoding time of the signal, other delays that may occur in rendering media by the rendering device, or some combination thereof. In response to reception of the response, the procedure 1600 may proceed to stage 1608.

In stage 1608, the module 106 may transmit a signal associated with an audio portion of media to the DUT 108. The DUT 108 may produce sound associated with the signal.

In stage 1610, the output timing of the sound produced by the DUT 108 may be determined. Stage 1610 may be performed while the module 106 is still transmitting the signal in stage 1608 or after the signal has been transmitted. The output timing may be determined by the analyzer 104, another module of the analyzer 104, the computer device 102, or some combination thereof. In particular, a time that the sound is produced by the DUT 108 may be compared with a time that the signal associated with sound was transmitted to determine a delay in the rendering of the audio portion.

In stage 1612, the module 106 may analyze the output timing of the sound produced by the DUT 108. In particular, the module 106 may compare the delay determined in stage 1610 with the synchronization delay time provided in stage 1606 to determine if the synchronization delay time was correctly reported. The module 106 may produce test results based on whether the provided synchronization delay time was reported correctly. The module 106 may return, via the analyzer 104, the test results to the computer device 102 in stage 1108 (FIG. 14) of the procedure 1100 (FIG. 14). In other embodiments, the module 106 may return, via the analyzer 104, the time that the signal was transmitted to the DUT 108 and the computer device 102 may have determined the output timing and the analyzed the output time, in which case stages 1610 and 1612 may be omitted.

Figure 20:
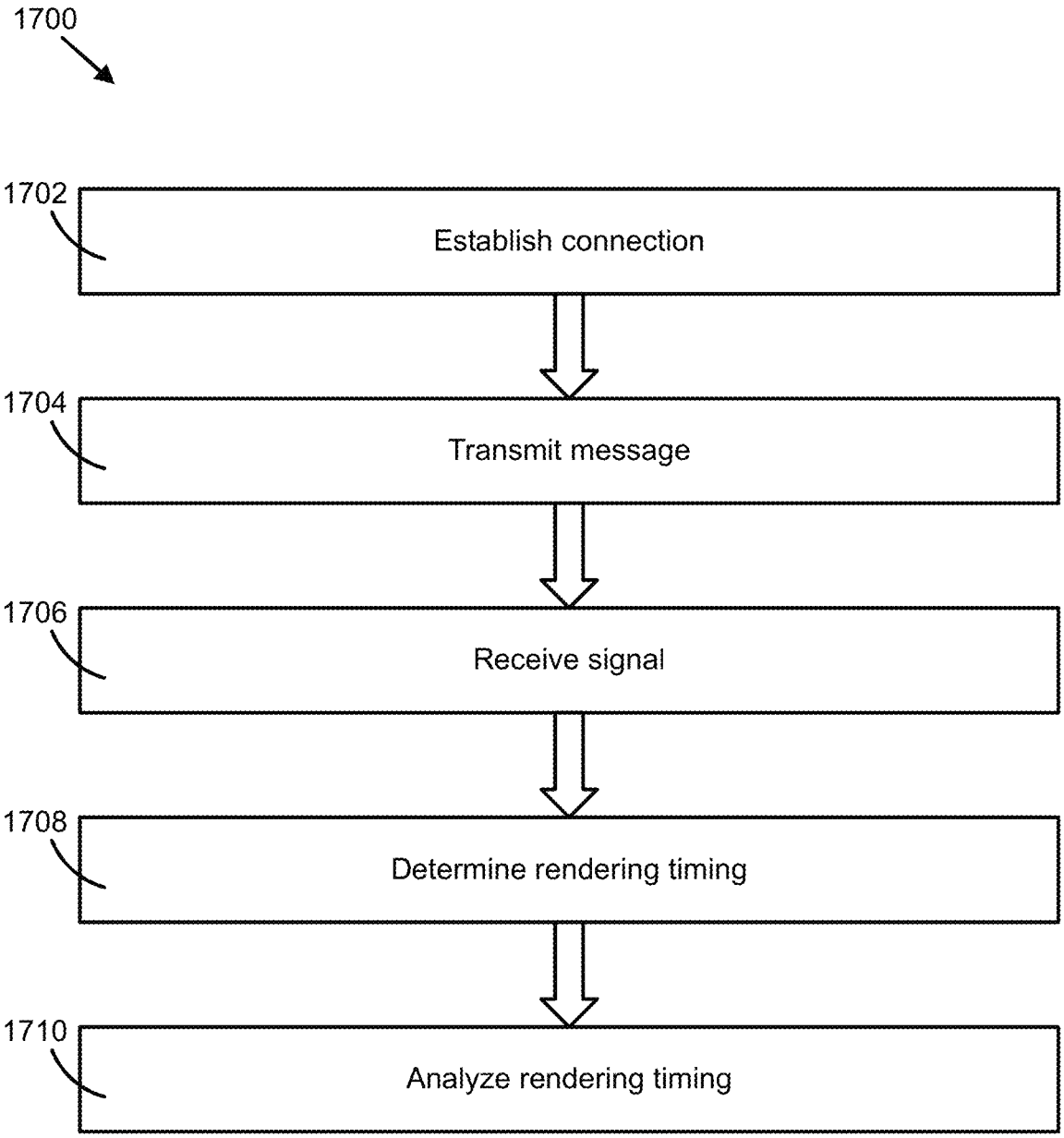
FIG. 20 illustrates another example test procedure associated with audio/visual synchronization delay, in accordance with various embodiments.

FIG. 20 illustrates another example test procedure 1700 associated with audio/visual synchronization delay, in accordance with various embodiments. Test procedure 1700 may be implemented for testing systems where the rendering of the visual portion is delayed. The test procedure 1700 may be performed in stage 1106 (FIG. 14) of procedure 1100 (FIG. 14). The module 106 (FIG. 1) may be configured as a rendering device in procedure 1700. Further, the DUT 108 (FIG. 1) may be a source device in procedure 1700.

In stage 1702, the module 106 may establish a connection with the DUT 108. Establishing the connection may include a handshake procedure between the module 106 and the DUT 108. The handshake procedure may include the DUT 108 requesting a wireless connection with the module 106 and the module 106 responding with acceptance of the wireless connection, which may include information for wirelessly communicating with the module 106. Once the wireless connection is established, the procedure 1700 may proceed to stage 1704. In other embodiments, a wireless connection may already be established between the module 106 and the DUT 108, in which case stage 1702 may be omitted.

In stage 1704, the module 106 may transmit a signal providing a synchronization delay time to the DUT 108. In response to transmission of the signal, the procedure 1700 may proceed to stage 1706.

In stage 1706, the module 106 may receive a signal associated with an audio portion of media from the DUT 108. The procedure 1700 may proceed to stage 1708 in response to reception of the signal.

In stage 1708, rendering timing of the visual portion rendered by the DUT 108 may be determined. Stage 1708 may be performed while the module 106 is still receiving the signal in stage 1706 or after the signal has been received. The rendering timing may be determined by the analyzer 104, another module of the analyzer 104, the computer device 102, or some combination thereof. In particular, a time that the visual portion is rendered by the DUT 108 may be compared with a time that the signal associated with visual portion was received to determine a delay in rendering of the visual portion.

In stage 1710, the module 106 may analyze the delay in rendering the visual portion by the DUT 108. In particular, the module 106 may compare the delay determined in stage 1708 with the synchronization delay time provided in stage 1704 to determine if the DUT 108 properly delayed rendering of the visual portion. The module 106 may produce test results based on whether the DUT 108 properly delayed rendering of the visual portion. The module 106 may return, via the analyzer 104, the test results to the computer device 102 in stage 1108 (FIG. 14) of the procedure 1100 (FIG. 14). In other embodiments, the module 106 may return, via the analyzer 104, the time that the signal was received to the DUT 108 and the computer device 102 may have determined the rendering timing and the analyzed the delay in rendering the visual portion, in which case stages 1610 and 1612 may be omitted.

Figure 21:
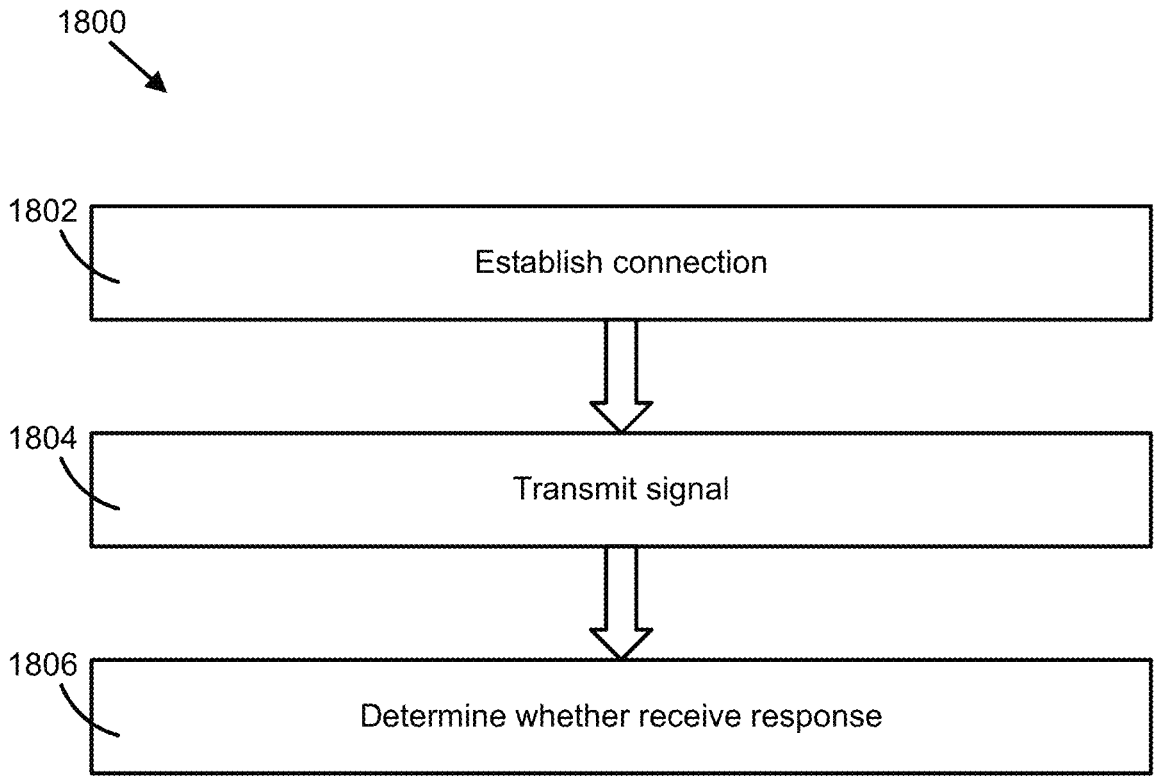
FIG. 21 illustrates another example test procedure associated with transmission power, in accordance with various embodiments.

FIG. 21 illustrates another example test procedure 1800 associated with transmission power, in accordance with various embodiments. The test procedure 1800 may be performed in stage 1106 (FIG. 14) of procedure 1100 (FIG. 14). The module 106 (FIG. 1) may be configured as a source device in procedure 1800. Further, the DUT 108 (FIG. 1) may be a rendering device in procedure 1800.

In stage 1802, the module 106 may establish a connection with the DUT 108. Establishing the connection may include a handshake procedure between the module 106 and the DUT 108. The handshake procedure may include the module 106 requesting a wireless connection with the DUT 108 and the DUT 108 responding with acceptance of the wireless connection, which may include information for wirelessly communicating with the DUT 108. Once the wireless connection is established, the procedure 1800 may proceed to stage 1804. In other embodiments, a wireless connection may already be established between the module 106 and the DUT 108, in which case stage 1802 may be omitted.

In stage 1804, the module 106 may transmit a signal to the DUT 108 at a certain transmission power. The certain transmission power may have been defined by the transmit power value 206*a* (FIG. 2) of the setting elements 206 (FIG. 2) of the user interface 200 (FIG. 2), and may have been implemented in the configuration of the module 106. The signal may include a request for a response from the DUT 108. In response to transmission of the signal, the procedure 1800 may proceed to stage 1806.

In stage 1806, the module 106 may determine if a response to the signal transmitted in stage 1804 has been received from the DUT 108. The module 106 may wait for a specified period of time after transmission of the signal to determine if the response has been received from the DUT 108. The module 106 may produce a test result that indicates whether the response signal was received from the DUT 108. The module 106 may return, via the analyzer 104, the test result to the computer device 102 (FIG. 1) in stage 1108 (FIG. 14) of the procedure 1100 (FIG. 14).

In instances where the module 106 is configured to perform a nested sweep procedure for transmission power, the procedure may repeat stages 1804 and 1806 for all the transmission values associated with the nested sweep procedure. In particular, after completing stage 1806 for one of the transmission values associated with the nested sweep procedure, the procedure 1800 may return stage 1804 and repeat stages 1804 and 1806 for a subsequent transmission value associated with the nested sweep procedure until stages 1804 and 1806 have been completed for all the transmission values associated with the nested sweep procedure.

Figure 22:
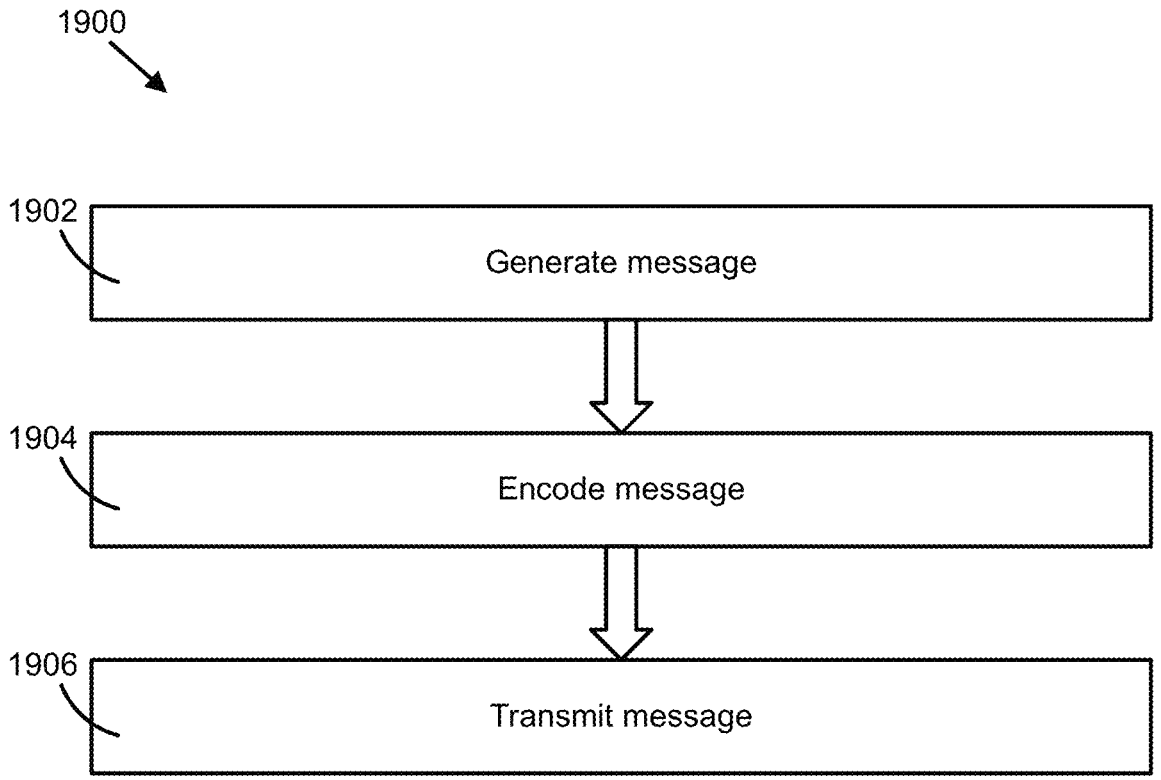
FIG. 22 illustrates an example encoding procedure, in accordance with various embodiments.

FIG. 22 illustrates an example encoding procedure 1900, in accordance with various embodiments. In particular, the module 106 (FIG. 1) may perform the procedure 1900 on every signal described throughout this disclosure being transmitted to the DUT 108 (FIG. 1) by the module 106 when the module 106 is configured to encode signals.

In stage 1902, the module 106 may generate a signal to be transmitted to the DUT 108.

In stage 1904, the module 106 may encode the signal. The module 106 may encode the signal in an encoding standard indicated within the codec settings 206*b* (FIG. 2) of the user interface screen 200 (FIG. 2). The module 106 may be capable of encoding signals in many different encoding standards including, but not limited to, AAC standard, SBC standard, aptX low latency standard, and/or aptX HD standard. Further, additional encoding standards capability may be added via firmware upgrades to the chipset of the module 106. For some encoding standards, the module 106 may utilize a processor of the analyzer 104 (FIG. 1) to perform the encoding. For example, the module 106 may cause the processor of the analyzer 104 to encode the signal in the AAC standard.

In stage 1906, the module 106 may transmit the encoded signal.

Figure 23:
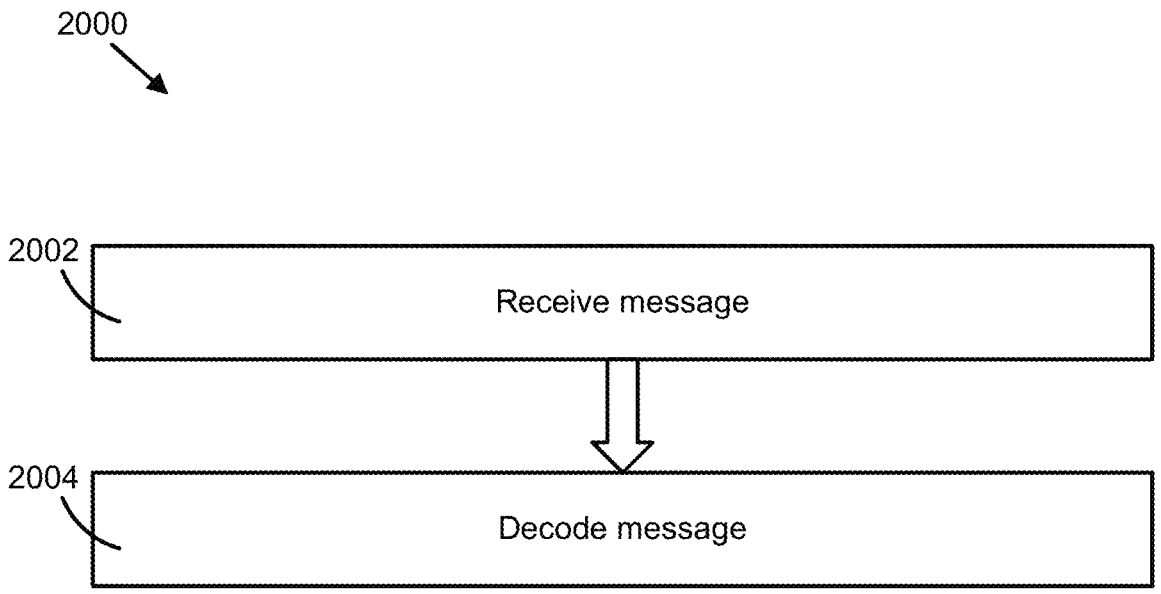
FIG. 23 illustrates an example decoding procedure, in accordance with various embodiments.

FIG. 23 illustrates an example decoding procedure 2000, in accordance with various embodiments. In particular, the module 106 (FIG. 1) may perform the procedure 200 on every signal described throughout this disclosure being received from the DUT 108 (FIG. 1) by the module 106 when the module 106 is configured to decode signals.

In stage 2002, the module 106 may receive a signal from the DUT 108.

In stage 2004, the module 106 may decode the signal. The module 106 may decode the signal from an encoding standard indicated within the codec settings 206*b* (FIG. 2) of the user interface screen 200 (FIG. 2). The module 106 may be capable of decoding signals in many different encoding standards including, but not limited to, AAC standard, SBC standard, aptX low latency standard, and/or aptX high density (HD) standard. Further, decoding of additional encoding standards capability may be added via firmware upgrades to the chipset of the module 106. For some encoding standards, the module 106 may utilize a processor of the analyzer 104 (FIG. 1) to perform the decoding. For example, the module 106 may cause the processor of the analyzer 104 to decode the signal from the AAC standard.

Figure 24:
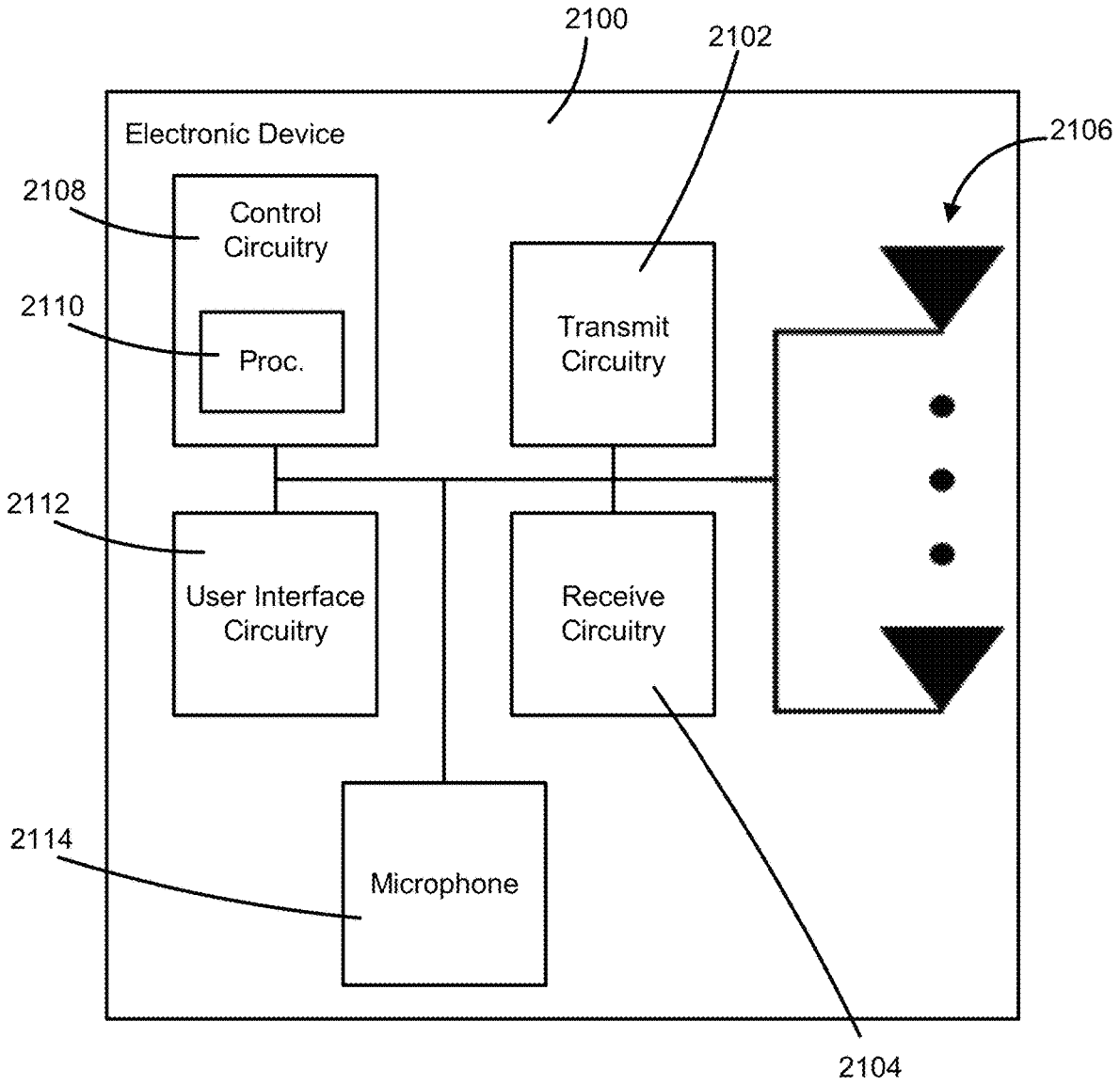
FIG. 24 depicts an example electronic device, in accordance with various embodiments, which may be an audio analyzer, such as the analyzer described herein.

FIG. 24 may depict an example electronic device 2100, in accordance with various embodiments, which may be an audio analyzer, such as the analyzer 104 (FIG. 1) described herein. In embodiments, the electronic device 2100 may include transmit circuitry 2102 which may be to transmit one or more signals such as Bluetooth signals and/or some other signal. The electronic device 2100 may further include receive circuitry 2104 which may be to receive one or more signals such as Bluetooth signals and/or some other type of signal. The electronic device 2100 may further include one or more antennas 2106 through which the transmit circuitry 2102 and/or receive circuitry 2104 may be configured to send and/or receive one or more wireless signals.

The transmit circuitry 2102, receive circuitry 2104, and/or antenna(s) 2106 may be coupled with control circuitry 2108 which may be and/or may include one or more processors 2110. The control circuitry 2108 may be configured to perform one or more operations and/or processes such as audio analysis processes as described herein. In some embodiments, the control circuitry 2108 may be coupled with one or more non-volatile memory (NVM) which may be configured to store instructions thereon that, when executed by the control circuitry 2108, cause the control circuitry 2108 to perform one or more operations and/or processes as described herein, or portions thereof. In some embodiments, the control circuitry 2108 may include or otherwise be coupled with user interface circuitry 2112 that may be configured to display (or facilitate display) of information to a user as shown in various Figures herein.

In some embodiments, the control circuitry 2108 may be to identify a parameter related to an Audio Video Remote Control Profile (AVRCP) profile playback status event, an AVRCP profile playback position event, an AVRCP Absolute Volume event, an audio/video (A/V) Sync Delay, a transmit power control, and/or a codec. The user interface circuitry 2112 may be to facilitate display of the parameter to a user.

In some embodiments, the electronic device 2100 may further include a microphone 2114 coupled to the control circuitry 2108. The microphone 2114 may capture sounds produced by a DUT (such as the DUT 108 (FIG. 1)) during test procedures. The control circuitry 2108 may control time periods when the microphone 2114 capture the sounds.

Figure 25:
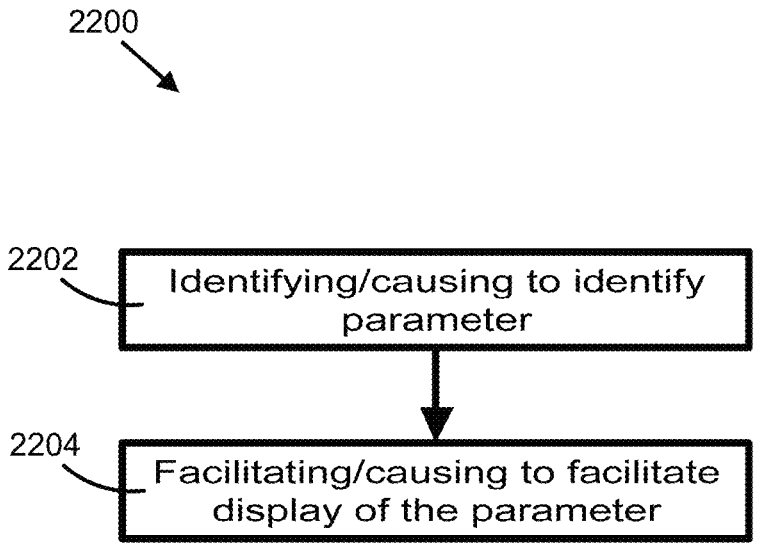
FIG. 25 depicts an example process to be performed by the electronic device of FIG. 24, in accordance with various embodiments.

In some embodiments, the electronic device of FIG. 24 may be configured to perform one or more processes, techniques, and/or methods as described herein, or portions thereof. One such process 2200 is depicted in FIG. 25. For example, the process 2200 may include stage 2202 that includes identifying or causing to identify a parameter related to an Audio Video Remote Control Profile (AVRCP) profile playback status event, an AVRCP profile playback position event, an AVRCP Absolute Volume event, an audio/video (A/V) Sync Delay, a transmit power control, and/or a codec; and stage 2204 that includes facilitating or cause to facilitate display of the parameter to a user.

Figure 26:
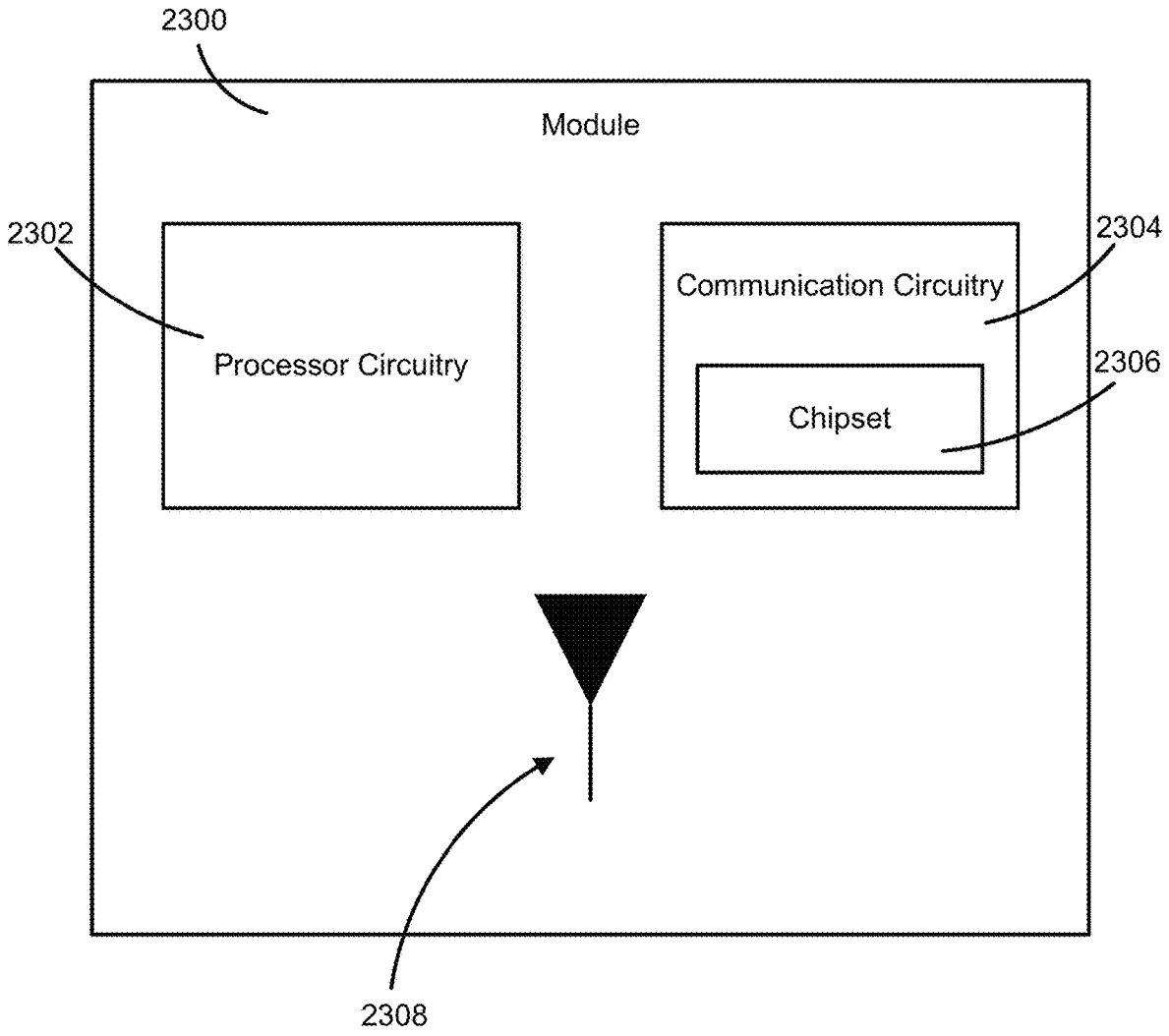
FIG. 26 illustrates an example module that may employ the apparatuses and/or methods described herein, in accordance with various embodiments.

FIG. 26 illustrates an example module 2300 that may employ the apparatuses and/or methods described herein (e.g., the module 106), in accordance with various embodiments. The module 2300 may include processor circuitry 2302. The processor circuitry 2302 may include a processor to perform one or more of the processing operations to be performed by the module 106 as described throughout this disclosure.

The module 2300 may further include communication circuitry 2304. The communication circuitry 2304 may be coupled to the processor circuitry 2302. The communication circuitry 2304 may facilitate wireless communication, such as the wireless communication to be performed by the processor described throughout this disclosure. For example, the communication circuitry 2304 may encode and/or decode signals transmitted and/or received by the module 2300. The communication circuitry 2304 may include a chipset 2306 that further facilitates the wireless communication. The chipset 2306 may implement any wireless communication standard known to one having ordinary skill in the art, including, but not limited to, Bluetooth, infrared, wireless fidelity (Wi-Fi), broadband wireless access, worldwide interoperability for microwave access (WiMAX), high performance radio local access network (HiperLAN), multichannel multipoint distribution service (MMDS), local multipoint distribution service (LMDS), global system for mobile communication (GSM), general packet radio service (GPRS), code division multiple access (CDMA), and/or high-speed downlink packet access (HSPA).

The module 2300 may further include one or more antennas 2308. The antennas 2308 may be coupled to the communication circuitry 2304 and may facilitate transmission of signals from the communication circuitry 2304 and/or to the communication circuitry 2304.

FIG. 27 illustrates an example computer device 2400 that may employ the apparatuses and/or methods described herein (e.g., the computer device 102), in accordance with various embodiments. As shown, computer device 2400 may include a number of components, such as one or more processor(s) 2404 (one shown) and at least one communication chip 2406. In various embodiments, the one or more processor(s) 2404 each may include one or more processor cores. In various embodiments, the at least one communication chip 2406 may be physically and electrically coupled to the one or more processor(s) 2404. In further implementations, the communication chip 2406 may be part of the one or more processor(s) 2404. In various embodiments, computer device 2400 may include printed circuit board (PCB) 2402. For these embodiments, the one or more processor(s) 2404 and communication chip 2406 may be disposed thereon. In alternate embodiments, the various components may be coupled without the employment of PCB 2402.

Depending on its applications, computer device 2400 may include other components that may or may not be physically and electrically coupled to the PCB 2402. These other components include, but are not limited to, memory controller 2426, volatile memory (e.g., dynamic random access memory (DRAM) 2420), non-volatile memory such as read only memory (ROM) 2424, flash memory 2422, storage device 2454 (e.g., a hard-disk drive (HDD)), an I/O controller 2441, a digital signal processor (not shown), a crypto processor (not shown), a graphics processor 2430, one or more antenna 2428, a display (not shown), a touch screen display 2432, a touch screen controller 2446, a microphone 2436, an audio codec (not shown), a video codec (not shown), a global positioning system (GPS) device 2440, a compass 2442, an accelerometer (not shown), a gyroscope (not shown), a speaker 2450, a camera 2452, and a mass storage device (such as hard disk drive, a solid state drive, compact disk (CD), digital versatile disk (DVD)) (not shown), and so forth.

In some embodiments, the one or more processor(s) 2404, flash memory 2422, and/or storage device 2454 may include associated firmware (not shown) storing programming instructions configured to enable computer device 2400, in response to execution of the programming instructions by one or more processor(s) 2404, to practice all or selected aspects of the methods described herein. In various embodiments, these aspects may additionally or alternatively be implemented using hardware separate from the one or more processor(s) 2404, flash memory 2422, or storage device 2454.

The communication chips 2406 may enable wired and/or wireless communications for the transfer of data to and from the computer device 2400. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 2406 may implement any of a number of wireless standards or protocols, including but not limited to IEEE 802.20, Long Term Evolution (LTE), LTE Advanced (LTE-A), General Packet Radio Service (GPRS), Evolution Data Optimized (Ev-DO), Evolved High Speed Packet Access (HSPA+), Evolved High Speed Downlink Packet Access (HSDPA+), Evolved High Speed Uplink Packet Access (HSUPA+), Global System for Mobile Communications (GSM), Enhanced Data rates for GSM Evolution (EDGE), Code Division Multiple Access (CDMA), Time Division Multiple Access (TDMA), Digital Enhanced Cordless Telecommunications (DECT), Worldwide Interoperability for Microwave Access (WiMAX), Bluetooth, derivatives thereof, as well as any other wireless protocols that are designated as 3G, 4G, 5G, and beyond. The computer device 2400 may include a plurality of communication chips 2406. For instance, a first communication chip 2406 may be dedicated to shorter range wireless communications such as Wi-Fi and Bluetooth, and a second communication chip 2406 may be dedicated to longer range wireless communications such as GPS, EDGE, GPRS, CDMA, WiMAX, LTE, Ev-DO, and others.

In various implementations, the computer device 2400 may be a laptop, a netbook, a notebook, an ultrabook, a smartphone, a computer tablet, a personal digital assistant (PDA), an ultra-mobile PC, a mobile phone, a desktop computer, a server, a printer, a scanner, a monitor, a set-top box, an entertainment control unit (e.g., a gaming console or automotive entertainment unit), a digital camera, an appliance, a portable music player, or a digital video recorder. In further implementations, the computer device 2400 may be any other electronic device that processes data.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

What is claimed is:

1. A module to be coupled to an analyzer and to test a device under test (DUT), the module comprising:

an antenna;

communication circuitry coupled to the antenna; and processor circuitry coupled to the communication circuitry, the processor circuitry to:

receive an indication of a configuration for the module, the configuration including an indication that the module is to act as an audio source device when the DUT is an audio rendering device or act as an audio rendering device when the DUT is an audio source device;

configure the module in accordance with the configuration;

cause the communication circuitry to establish a wireless connection between the module and the DUT; and cause the communication circuitry to perform a test procedure for the DUT via the wireless connection.

2. The module of claim 1, wherein the communication circuitry includes a chipset, and wherein to configure the module includes to configure firmware of the chipset in accordance with the configuration.

3. The module of claim 1, wherein the configuration indicates that the module is to be configured as the audio source device for the performance of the test procedure, wherein to configure the module includes to adopt, via the module, a profile corresponding to the audio source device for the performance of the test procedure, and wherein the DUT is configured to receive a signal from the module or another audio source device and generate an audio output based on the signal.

4. The module of claim 1, wherein the configuration indicates that the module is to be configured as the audio rendering device for the performance of the test procedure, wherein to configure the module includes to adopt, via the module, a profile corresponding to the audio rendering device for the performance of the test procedure, and wherein the DUT is configured to generate a signal usable by the module or another audio rendering device to generate an audio output.

5. The module of claim 1, wherein the configuration indicates that the test procedure is to include a test procedure associated with playback status and playback position, and wherein the test procedure includes sending a signal via the communication circuitry to the DUT, the signal including a simulated playback status and/or a simulated playback position and a request for a response from the DUT that includes the simulated playback status and/or the simulated playback position.

6. The module of claim 1, wherein the configuration indicates that the test procedure is to include a test procedure associated with absolute volume, and wherein the test procedure includes sending a first signal and a second signal via the communication circuitry to the DUT, the first signal including absolute volume parameters and the second signal including a sound to be produced by the DUT.

7. The module of claim 1, wherein the configuration indicates that the test procedure is to include a test procedure associated with audio/visual synchronization delay, and wherein the test procedure includes sending a signal via the communication circuitry to the DUT, the signal including a request for a synchronization delay time from the DUT.

8. The module of claim 1, wherein the configuration indicates that the test procedure is to include a test procedure associated with transmission power, and wherein the test procedure includes sending a signal via the communication circuitry to the DUT, the signal transmitted at a predefined transmission power, the predefined transmission power implemented in the configuration of the module.

9. The module of claim 1, wherein the configuration indicates an encoding standard to be utilized by the module, and wherein the communication circuitry is to:

encode signals to be transmitted to the DUT during the test procedure in accordance with the encoding standard; and decode signals received from DUT during the test procedure in accordance with the encoding standard.

10. The module of claim 1, wherein to encode the signals to be transmitted to the DUT includes to utilize a processor of the analyzer to encode the signals to be transmitted to the DUT in accordance with the encoding standard, and wherein to decode the signals received from the DUT includes to utilize the processor of the analyzer to decode the signals.

11. The module of claim 1, wherein the processor circuitry is further to:

cause the communication circuitry to produce a test result based on the test procedure; and transmit, via the analyzer, the test result to a computer device coupled to the analyzer for analysis of the test result by the computer device.

12. A system, comprising:

a module to test a device under test (DUT), the module comprising:

an antenna;

communication circuitry coupled to the antenna; and processor circuitry coupled to the communication circuitry, the processor circuitry to:

receive an indication of a configuration for the module, the configuration including an indication that the module is to act as an audio source device based on a determination that the DUT is an audio rendering device or an indication that the module is to act as an audio rendering device based on a determination that the DUT is an audio source device;

configure the module in accordance with the configuration;

cause the communication circuitry to establish a wireless connection between the module and the DUT;

cause the communication circuitry to perform a test procedure for the DUT via the wireless connection, including sending one or more test signals to the DUT; and determine test results based on a response of the DUT to the one or more test signals; and an audio analyzer comprising control circuitry to send the test results to a computer device.

13. The system of claim 12, wherein the one or more test signals include a simulated playback status and/or a simulated playback position and a request for a response from the DUT that includes the simulated playback status and/or the simulated playback position.

14. The system of claim 12, wherein the one or more test signals include a first signal including absolute volume parameters and a second signal including a sound to be produced by the DUT.

15. The system of claim 14, wherein the audio analyzer further comprises a microphone coupled to the control circuitry, the microphone configured to capture the sound produced by the DUT in response to the second signal.

16. The system of claim 12, wherein the one or more test signals include a request for a synchronization delay time from the DUT.

17. The system of claim 12, wherein the one or more test signals include a transmission signal transmitted at a predefined transmission power, the predefined transmission power implemented in the configuration of the module.

18. The system of claim 12, wherein the audio analyzer is configured to send the indication of the configuration for the module to the module.

* * * * *